US011342714B2

(12) United States Patent
Helm et al.

(10) Patent No.: US 11,342,714 B2
(45) Date of Patent: May 24, 2022

(54) CONNECTOR HOUSING, MATING CONNECTOR HOUSING AND SYSTEM

(71) Applicant: TE Connectivity Germany GmbH, Bensheim (DE)

(72) Inventors: Sebastian Helm, Fuerth/Fahrenbach (DE); Joachim Barth, Stuttgart (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/797,485

(22) Filed: Feb. 21, 2020

(65) Prior Publication Data

US 2020/0366033 A1 Nov. 19, 2020

(30) Foreign Application Priority Data

May 14, 2019 (DE) ..... 102019112576.6

(51) Int. Cl.
*H01R 13/6584* (2011.01)
*H01R 13/6597* (2011.01)

(52) U.S. Cl.
CPC ..... *H01R 13/6584* (2013.01); *H01R 13/6597* (2013.01)

(58) Field of Classification Search
CPC ..... H01R 13/6582; H01R 13/6583; H01R 13/6585; H01R 23/684; H01R 23/6826; H01R 13/6584; H01R 13/6597
USPC ..... 439/260, 607.17–607.19, 607.26
See application file for complete search history.

(56) References Cited

U.S. PATENT DOCUMENTS

| | | | | |
|---|---|---|---|---|
| 4,598,966 | A * | 7/1986 | Boland | H05K 1/117 439/260 |
| 5,766,041 | A * | 6/1998 | Morin | H01R 13/74 439/607.19 |
| 5,795,171 | A * | 8/1998 | Bernardini | H01R 13/193 439/260 |
| 6,568,958 | B2 * | 5/2003 | Zhang | H01R 13/6485 439/540.1 |
| 7,390,208 | B1 * | 6/2008 | Sabo | H01R 12/57 439/260 |
| 10,044,147 | B2 * | 8/2018 | Listing | H01R 13/533 |
| 2002/0064988 | A1 * | 5/2002 | Fujita | H01R 13/7034 439/260 |
| 2004/0132341 | A1 | 7/2004 | Noguchi et al. | |
| 2005/0026500 | A1 * | 2/2005 | Ji | H01R 13/6582 439/607.01 |

(Continued)

FOREIGN PATENT DOCUMENTS

| | | |
|---|---|---|
| EP | 0977312 A2 | 2/2000 |
| WO | 2018003466 A1 | 1/2018 |

OTHER PUBLICATIONS

German Office Action, App. No. 102019112576.6, dated Jan. 17, 2020, 10 pages.

(Continued)

*Primary Examiner* — Gary F Paumen
(74) *Attorney, Agent, or Firm* — Barley Snyder

(57) ABSTRACT

A connector housing for an electrical connector includes a housing part and a shielding element disposed on the housing part. The shielding element has a contact spring contacting a shielding part of a mating connector housing. The contact spring is bent and pressed against the shielding part during a plugging operation between the connector housing and the mating connector housing.

18 Claims, 19 Drawing Sheets

(56) References Cited

U.S. PATENT DOCUMENTS

| | | | | |
|---|---|---|---|---|
| 2005/0118883 | A1 | 6/2005 | Kim | |
| 2011/0230086 | A1* | 9/2011 | Fujiwara | H01R 13/6584 439/559 |
| 2015/0093936 | A1* | 4/2015 | Little | H01R 13/6583 439/607.19 |
| 2018/0102611 | A1* | 4/2018 | Abouklassem | H01R 13/6583 |

OTHER PUBLICATIONS

Extended European Search Report, European Application No. 20173963.
8-1201, European Filing Date, Sep. 9, 2020.

* cited by examiner

CONNECTOR HOUSING, MATING CONNECTOR HOUSING AND SYSTEM

CROSS-REFERENCE TO RELATED APPLICATION

This application claims the benefit of the filing date under 35 U.S.C. § 119(a)-(d) of German Patent Application No. 102019112576.6, filed on May 14, 2019.

FIELD OF THE INVENTION

The present invention relates to a connector housing and, more particularly, to a connector housing having a shielding element.

BACKGROUND

Plug systems for establishing and disconnecting electrical connections are known in different embodiments. Systems used to, for example, connect one line to another device or line can comprise an electrical connector, also referred to as a plug connector, and a mating connector or mating plug connector that can be plugged into the connector. Plug connectors and mating plug connectors can have their own housings in which contact devices with corresponding contact elements, for example male and female contact elements, can be accommodated.

The housings can be provided with metallic shielding parts to ensure electromagnetic compatibility (EMC). Separate metallic spring parts can be used to establish an electrical connection between the shielding parts of the housing. A spring part can be designed such that the electrical connection can be established by frictional contacting. In such an embodiment, the spring part rubs against a shielding part during the plugging process. This entails abrasion and thus wear, which can limit the number of possible plugging cycles.

SUMMARY

A connector housing for an electrical connector includes a housing part and a shielding element disposed on the housing part. The shielding element has a contact spring contacting a shielding part of a mating connector housing. The contact spring is bent and pressed against the shielding part during a plugging operation between the connector housing and the mating connector housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
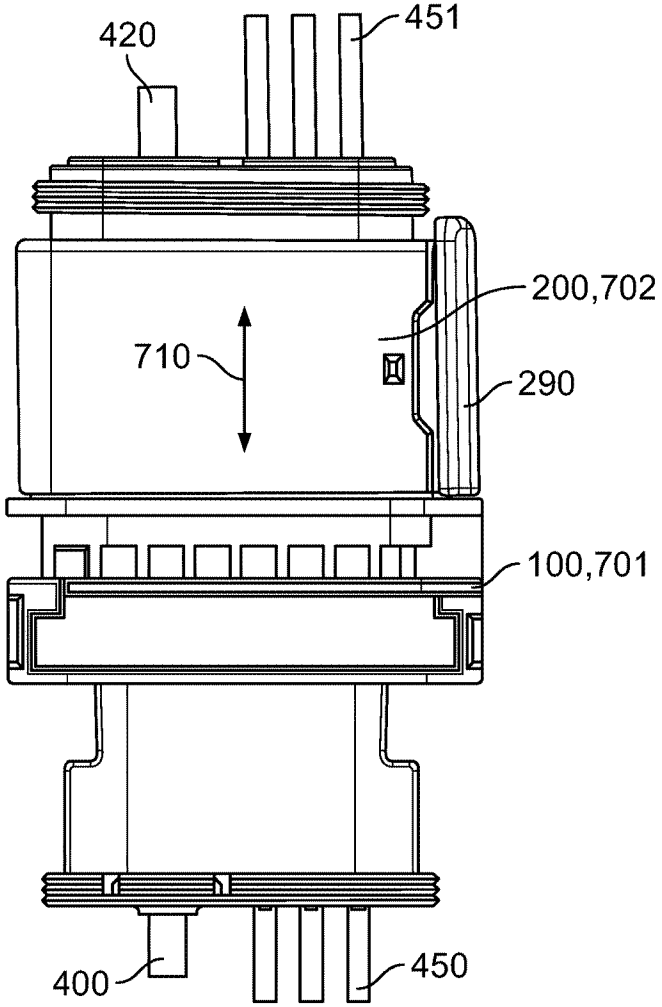
FIG. 2 is a side view of the system of FIG. 1.

The present invention will be described in greater detail below with reference to the embodiments illustrated in the following figures. The same parts are provided with the same reference numerals and the same component names. Furthermore, individual features or combinations of features from the embodiments shown and described can also represent independent inventive solutions or solutions in accordance with the invention. The embodiments described below can be used individually or in any combination with one another, except, for example, in the case of clear dependencies or incompatible alternatives.

Figure 1:
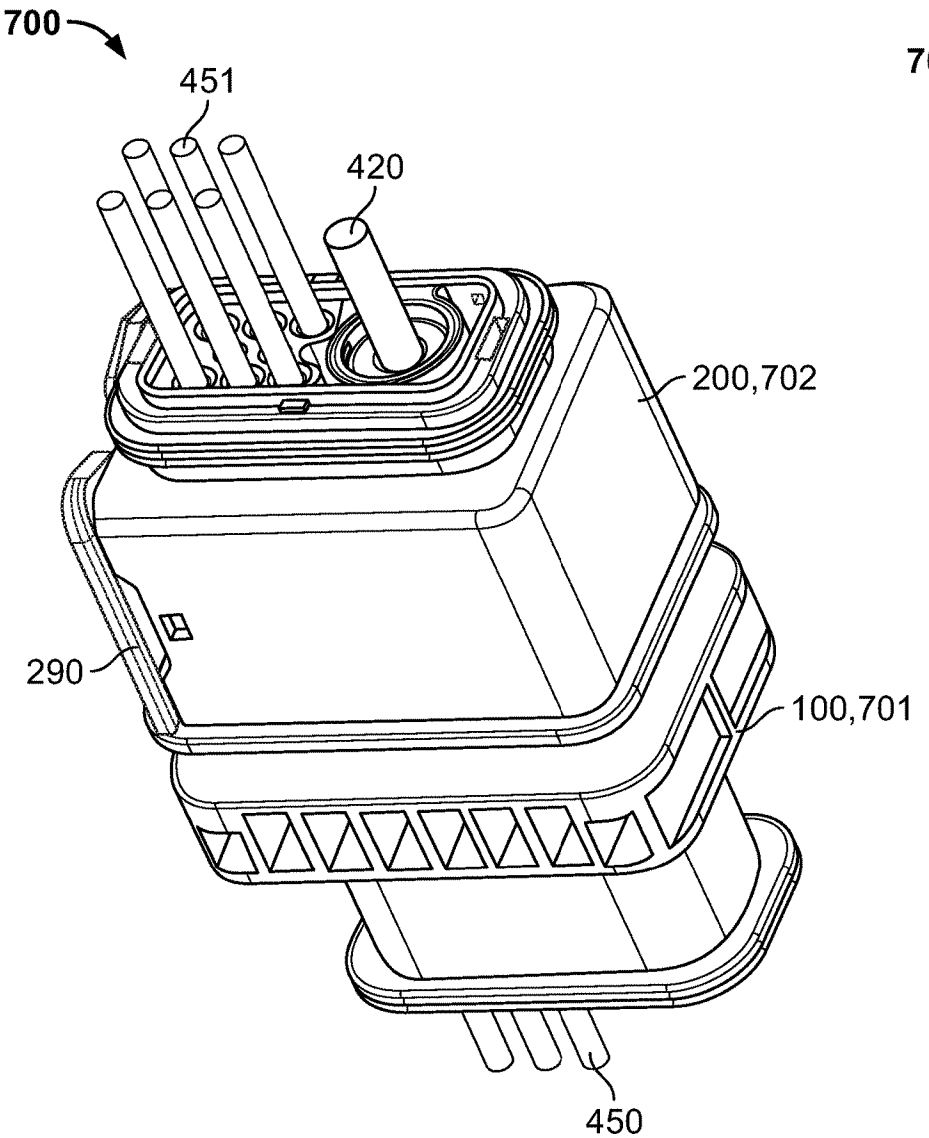
FIG. 1 is a perspective view of a system comprising a plug connector and a mating plug connector in an assembled state.

A system 700 according to an embodiment, as shown in FIGS. 1 and 2, comprises a plug connector 701 with a connector housing 100 and a mating connector 702 corresponding thereto with a mating connector housing 200. The two connectors 701, 702 and housings 100, 200 are shown in FIGS. 1 and 2 in an assembled state. A plug-in direction 710, along which these components 100, 200, 701, 702 can be plugged together and unplugged again, is indicated in FIG. 2.

Figure 3:
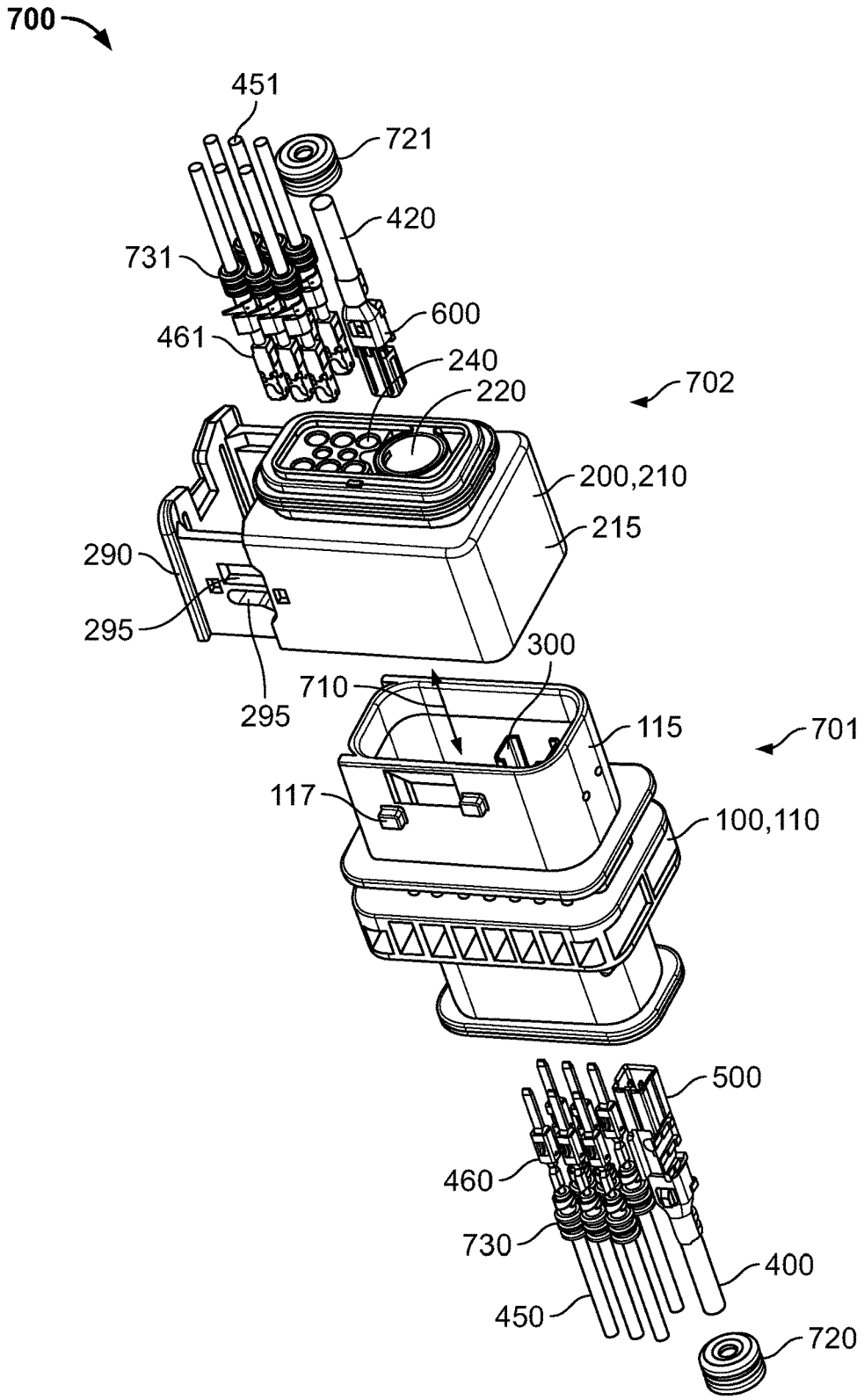
FIG. 3 is an exploded perspective view of the system of FIG. 1.

In the connector housing 100, as shown in FIG. 3, a contact device 500 connected to a line 400 and a plurality, i.e. six, metallic contact elements 460, are received which are connected to lines 450. In the mating connector housing 200, a mating contact device 600 connected to a line 420 and a plurality of, i.e. six, metallic mating contact elements 461 are accommodated, which are connected to lines 451. The connector 701 is realized by assembling the contact device 500 and mounting it on the line 400, connecting the contact elements 460 to the lines 450, and arranging the contact device 500 and the contact elements 460 on/in the connector housing 100. In the same way, the mating connector 702 is realized by assembling the mating contact device 600 and connecting it to the line 420, mounting the mating contact elements 461 on the lines 451, and arranging the mating contact device 600 and the mating contact elements 461 on/in the mating connector housing 200.

The lines 400, 420, in an embodiment, are two-wire data lines used for data transmission. The other lines 450, 451 are single-core lines which are used for the current or voltage supply. In the plugged state shown in FIGS. 1 and 2, in which the contact device 500 and the mating contact device 600 as well as the contact elements 460 and the mating contact elements 461 are plugged together, the contact devices 500, 600 and the contact elements 460, 461 and thus lines 400, 420 and lines 450, 451, are electrically connected to one another.

In the embodiment shown in FIG. 3, the contact elements 460 are male contact elements or contact pins, and the mating contact elements 461 are female contact elements or contact sockets. The contact elements 460, 461 can be crimped to the lines 450, 451 and connected to their wires, and have crimp tabs for this purpose. The contact device 500 comprises two male metallic contact elements 540, and the mating contact device 600 comprises two female metallic mating contact elements 640, as will be explained in more detail below.

As shown in FIG. 3, the connector housing 100 has a housing part 110 made of a plastic material and a metallic shielding element 300 disposed on/in the housing part 110. The shielding element 300 is used to contact a metallic shielding part 520 of the contact device 500 and a metallic shielding part 620 of the mating contact device 600 shown in FIGS. 4 and 5. The shielding part 520 of the contact device 500 is contacted when the contact device 500 is mounted on/in the housing part 110 of the connector housing 100, and the contacting of the shielding part 620 of the mating contact device 600 takes place during the plugging process between the two housings 100, 200 and thus between the two connectors 701, 702. The shielding element 300 and the shielding parts 520, 620 serve to ensure electromagnetic compatibility. In addition, the connector housing 100 comprises a fastening part 180 which is movably disposed on the housing part 110 and is made of a plastic material and serves to fix the contact device 500 to the housing part 110. Details on this will be discussed in more detail below.

As shown in FIG. 3, the housing part 110 of the connector housing 100 has a circumferential wall 115 in a front section. When the two housings 100, 200 are plugged together, the wall 115 is accommodated in the mating connector housing 200. A plurality of, e.g., four, locking projections 117 are formed on an outside of the wall 115 (see also FIG. 14). These are used for interlocking with the mating connector housing 200.

The mating connector housing 200 comprises a housing part 210 made of a plastic material, on which a locking slide 290 cooperating with the locking projections 117 of the connector housing 100 is movably disposed. The locking slide 290, which can be made of a plastic material, is shown in FIG. 3 in an extended starting position and in FIGS. 1 and 2 in a retracted end- or locking position. As indicated in FIG. 3, the locking slide 290 includes track- or slot-shaped cut-outs 295 for receiving the locking projections 117. During the plugging process, the two housings 100, 200 can be plugged together, the locking projections 117 being able to be received in the housing part 210 of the mating connector housing 200 and thereby in the cut-outs 295 of the locking slide 290. By manually moving the locking slide 290 from its initial position into the locking position, the housings 100, 200 can be releasably locked together. By moving the locking slide 290 back to its initial position, the housings 100, 200 can be released again and thereby separated from one another.

A configuration is also possible in which the two housings 100, 200 are partially joined during the plugging process, the locking projections 117 being received in the cut-outs of the locking slide 290, and in which the locking slide 290 is moved manually from the initial into the locking position, the housings 100, 200 able to be completely pulled together by the cooperation of the cut-outs 295 with the locking projections 117. By moving the locking slide 290 back to its initial position, the housings 100, 200 can be pushed apart and released and then completely separated from one another.

The housing part 210 of the mating connector housing 200 has a peripheral wall 215 which, when the two housings 100, 200 are plugged in, surrounds the wall 115 of the connector housing 100, as shown in FIGS. 1-3. Furthermore, the housing part 210 has a receiving chamber 220 for receiving the mating contact device 600 disposed on the line 420, and a plurality, e.g., six receiving chambers 240 for receiving the mating contact elements 461 disposed on the lines 451. The receiving chambers 220, 240 are adapted to the shapes of the mating contact device 600 and mating contact elements 461 and are formed by housing walls of the housing part 210.

Figure 20:
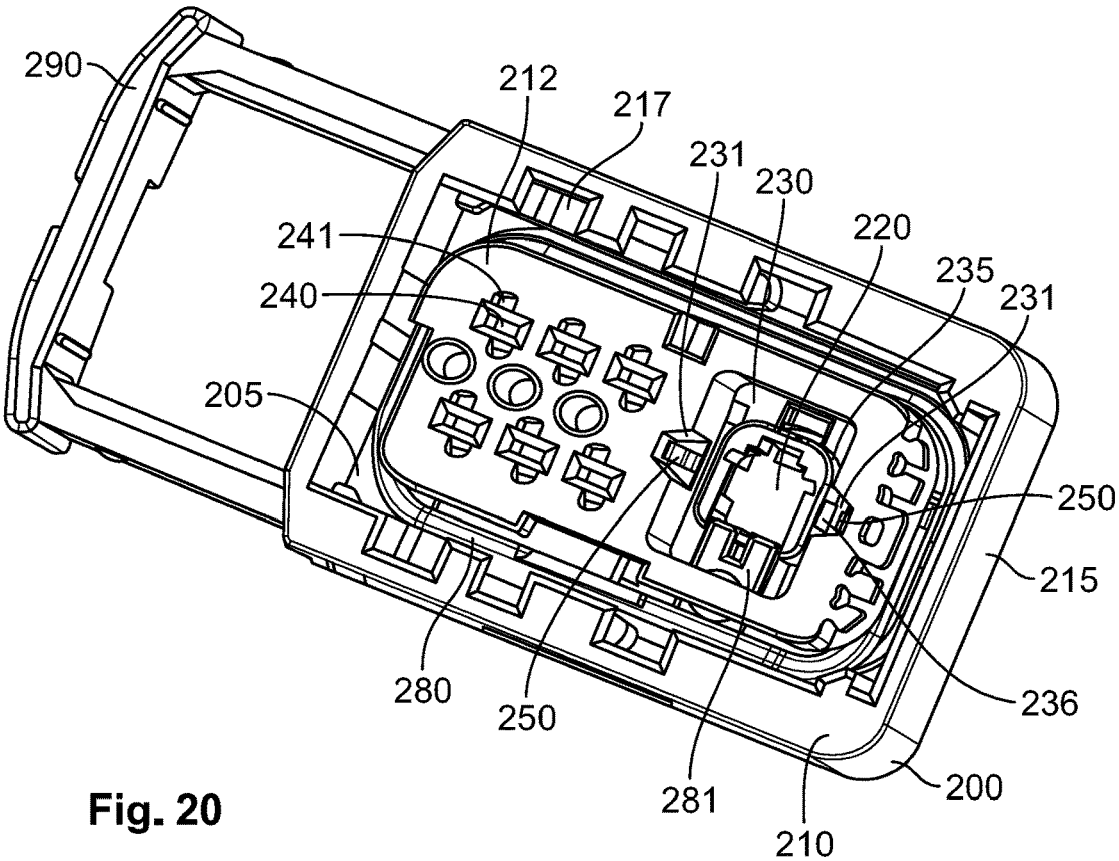
FIG. 20 is another perspective view of the mating connector housing.
Figure 22:
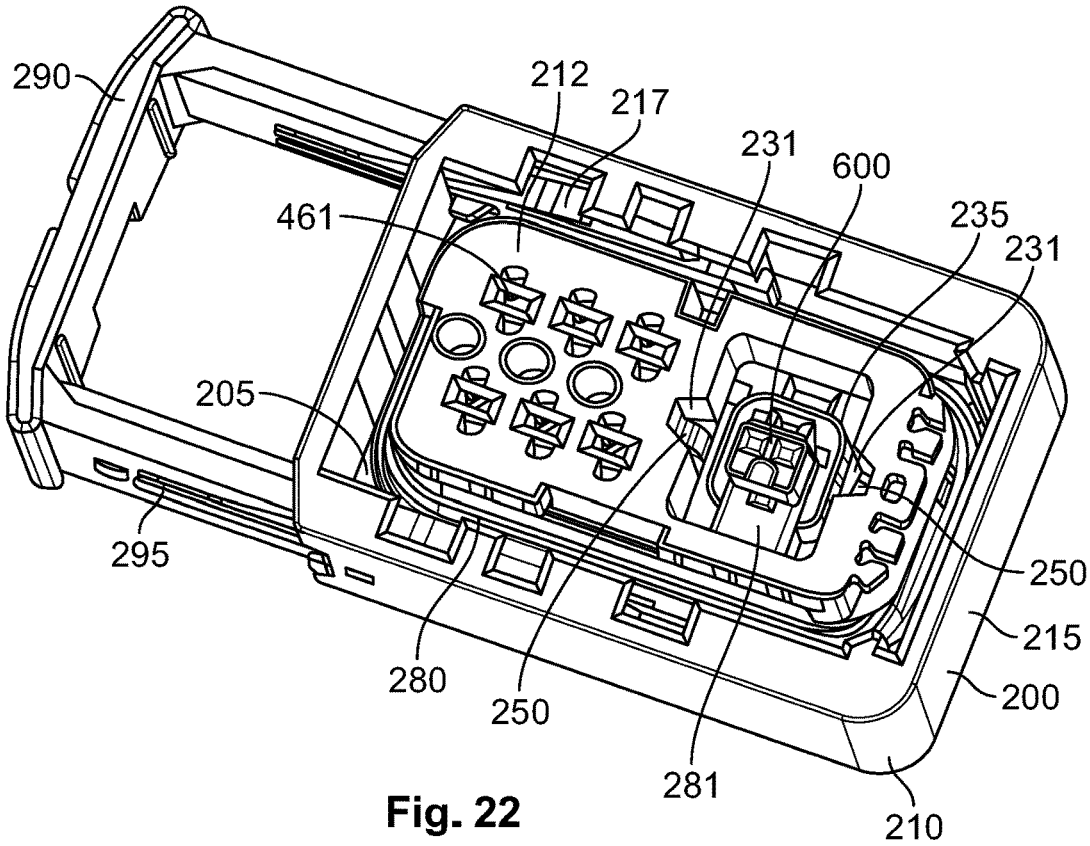
FIG. 22 is another perspective view of the mating connector housing.

The mating contact device 600 and mating contact elements 461 can be inserted from the rear into the housing chambers 220, 240 of the housing part 210 as indicated in FIG. 3, which shows, among other things, the back of housing part 210 (see the front views of FIGS. 20 and 22 for clarification). This also applies to the sealing elements 721, 731 assigned to the receiving chambers 220, 240, by which the receiving chambers 220, 240 of the housing part 210 can be sealed on the rear side. The sealing elements 721, 731 can be made of an elastically deformable plastic material.

Figure 18:
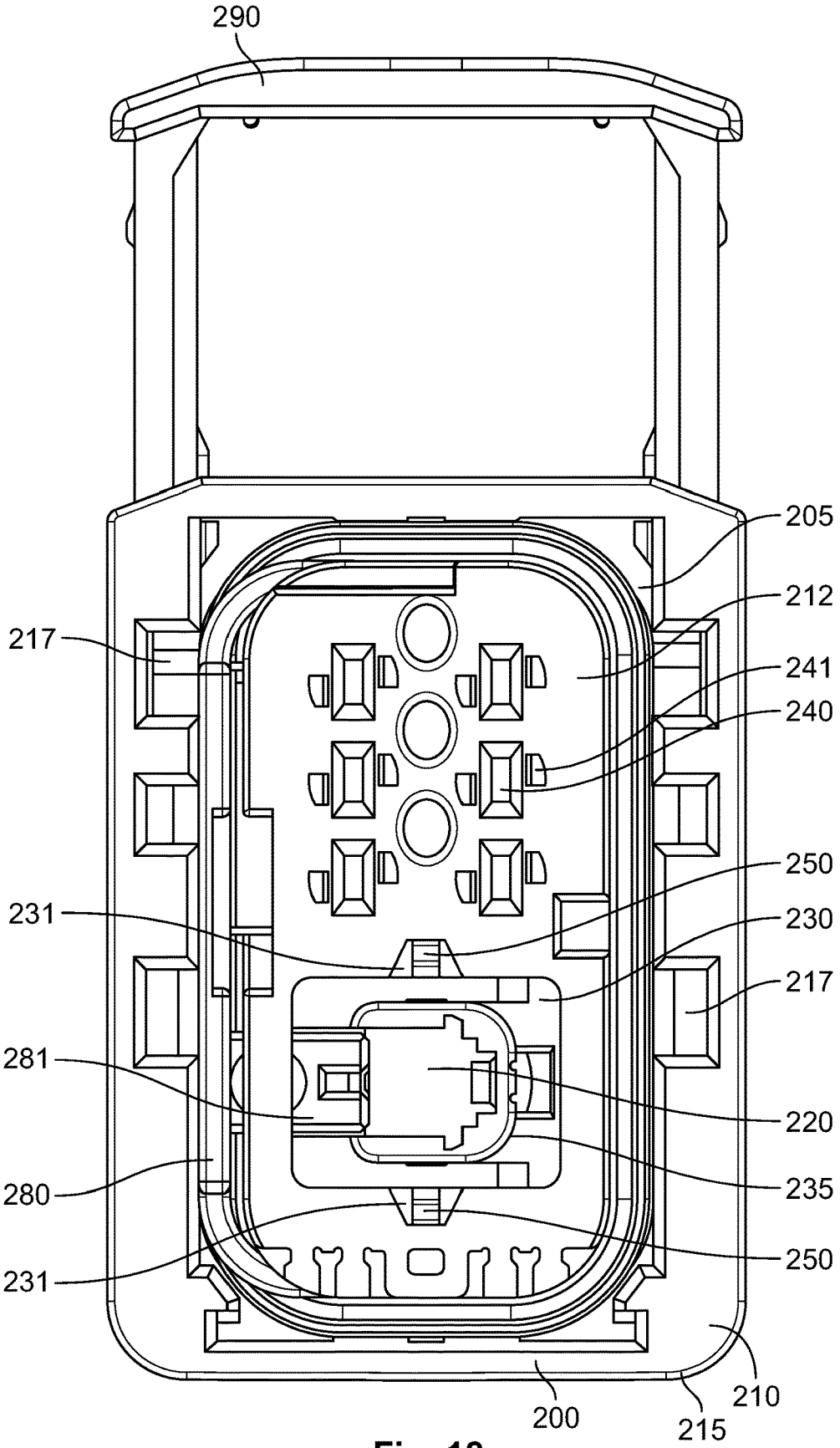
FIG. 18 is a top view of a mating connector housing.
Figure 19:
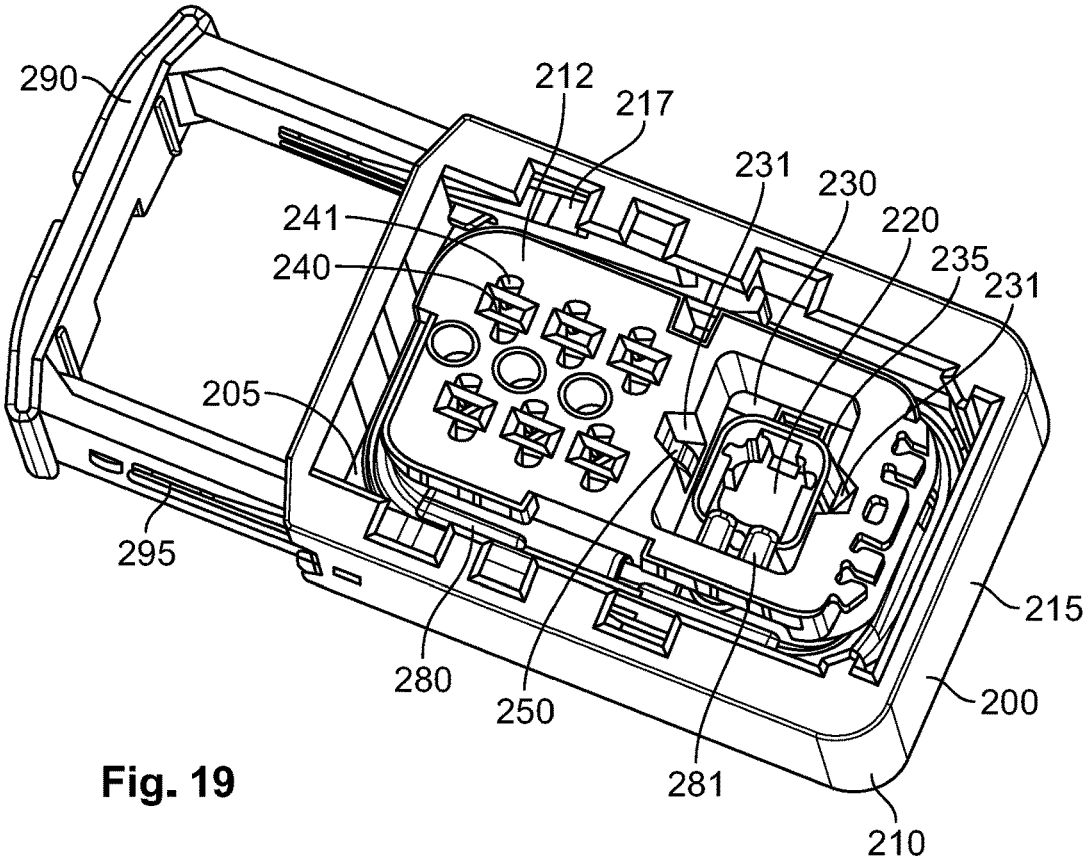
FIG. 19 is a perspective view of the mating connector housing.

The mating connector housing 200 also includes a fastening part 280, shown in FIGS. 18-20, which is movably disposed on the housing part 210 and is made of a plastic material and serves to fix the mating contact device 600 on the housing part 210. This will be discussed in more detail below.

The housing part 110 of the connector housing 100, as shown in FIGS. 12-15, has a receiving chamber 120 for receiving the contact device 500 disposed on the line 400, and a plurality, e.g., six receiving chambers 140 for receiving the contact elements 460 disposed on the lines 450. The receiving chambers 120, 140 are adapted to the shapes of the contact device 500 and contact elements 460, and are formed by housing walls of the housing part 110. The contact device 500 and the contact elements 460 can be inserted from the rear into the receiving chambers 120, 140 of the housing part 110, as indicated in FIG. 3. This applies in a corresponding manner to the sealing elements 720, 730 associated with the receiving chambers 120, 140, by which the receiving chambers 120, 140 of the housing part 110 can be sealed on the rear side. The sealing elements 720, 730 can be made of an elastically deformable plastic material.

Figure 4:
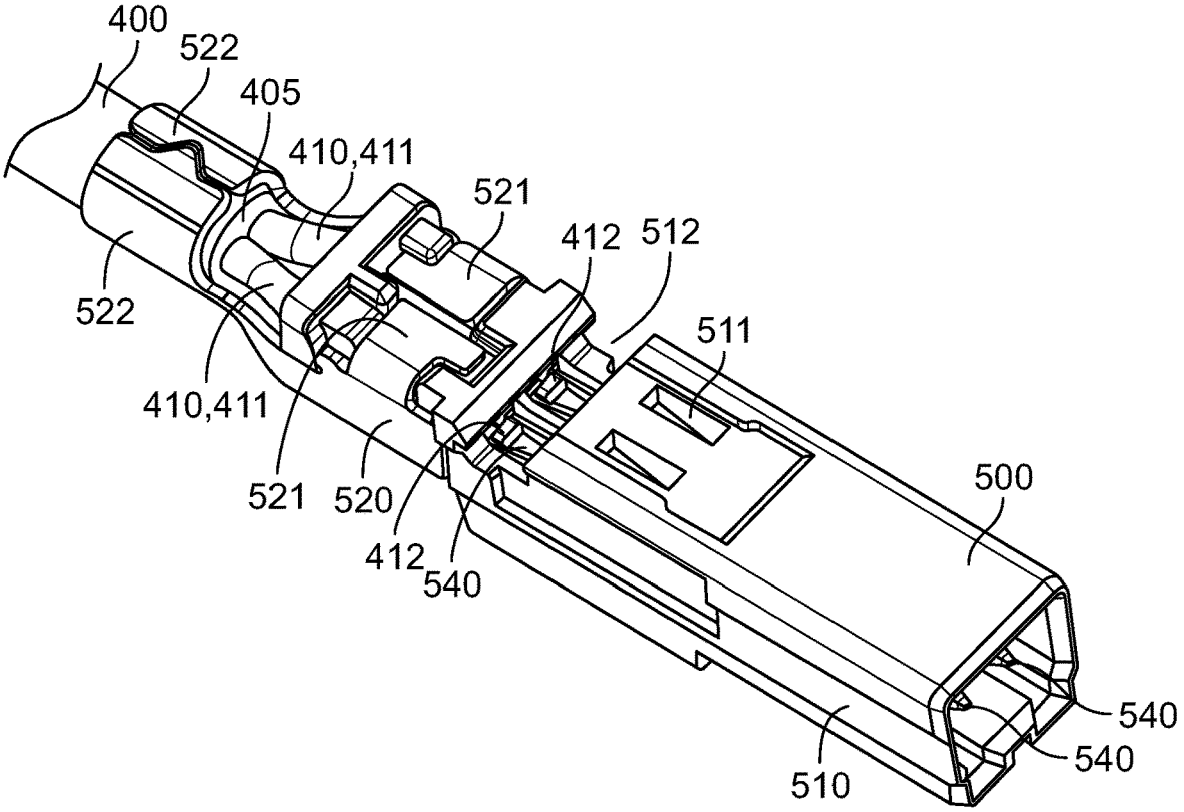
FIG. 4 is a perspective view of a contact device.

FIG. 4 shows an enlarged perspective illustration of the contact device 500 connected to one end of the line 400. The two-wire line 400 comprises two individual lines 410, which are enclosed by a jacket 405. In the assembled state, as shown in FIG. 4, the individual lines 410 protrude from the jacket 405 in the area of the line end. The individual lines 410 each have their own insulation 411 surrounding conductors 412, shown in FIG. 6. The jacket 405 and the insulation 411 can be made of a plastic material. The conductors 412 are designed to be electrically conductive or metallic. As further shown in FIG. 4, the contact device 500 has a contact insert 510 which serves as a housing and is made of a plastic material, the above-mentioned two male contact elements 540 being disposed in the insert. The contact elements 540 are fastened to the individual lines 410 and connected to the conductors 412 thereof, which protrude from the insulation 411 in the assembled state.

Figure 6:
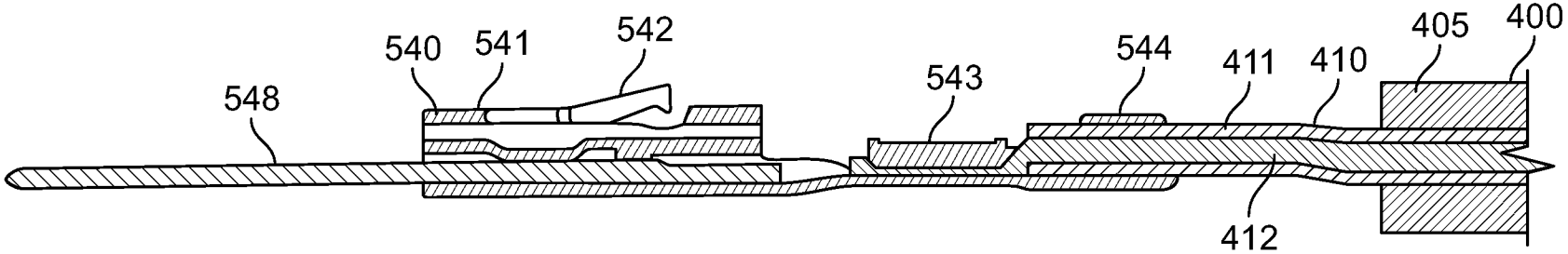
FIG. 6 is a sectional side view of a contact element of the contact device of FIG. 4.

As shown in FIG. 6, with reference to a single contact element 540, the contact elements 540 have crimp tabs 543, 544 disposed in an offset fashion, the tabs fastening the contact elements 540 to the conductor 412 and to the insulation 411 of the respective individual line 410. FIG. 6 shows an embodiment of the contact elements 540 with a socket contact section 541 and a pin contact section 548 which is inserted into the socket contact section 541 and protrudes therefrom. The socket contact section 541 has a latching hook 542 on the outside. Corresponding to this, as shown in FIG. 4, the contact insert 510 of the contact device 500 comprises two slot-shaped cut-outs 511, into which the latching hooks 542 of the contact elements 540 engage when they are mounted on/in the contact insert 510, the contact elements 540 thereby able to be securely attached to the contact insert 510.

Figure 29:
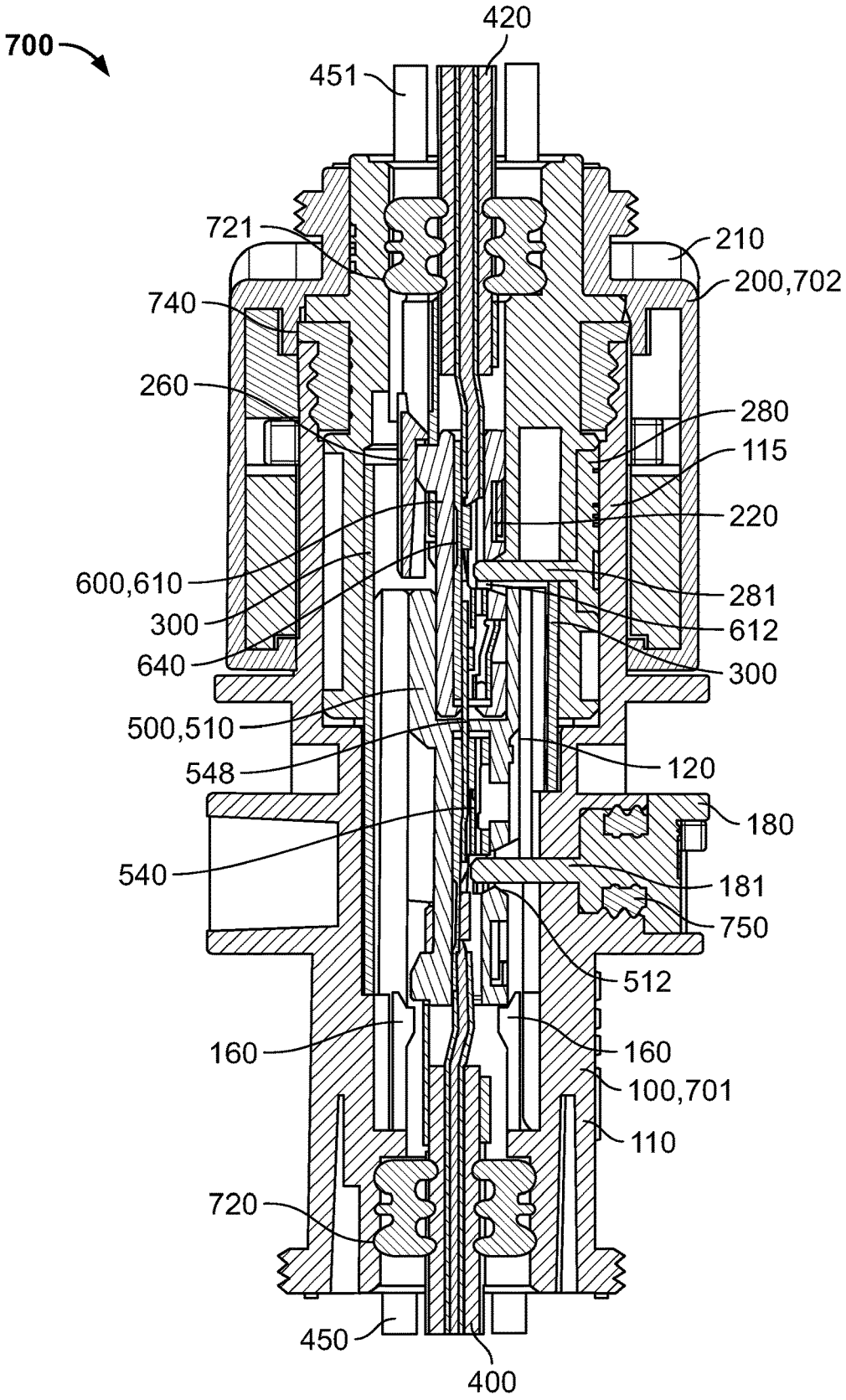
FIG. 29 is another sectional side view of the plug connector and the mating plug connector in the assembled state.

As shown in FIG. 4, the contact insert 510 comprises a cut-out 512 in a central area, the contact elements 540 also being partially released by the cut-out 512. In this area, a fastening section 181 of the above-mentioned movable fastening part 180 of the connector housing 100 can be brought into engagement with the contact insert 510 and the contact elements 540, as a result of which the contact elements can be securely fixed to the housing part 110 of the connector housing 100, as shown in FIG. 29.

The metallic shielding part 520, in the assembled state as shown in FIG. 4, is disposed on the contact insert 510 and on the line 400. The shielding part 520 has a pair of crimping tabs 521 in a front-side area for fastening the shielding part 520 to a rear-side area of the contact insert 510. In this area, the assembled shielding part 520 can have a substantially closed or circumferential shape. The shielding part 520 has two further crimping tabs 522 in a rear section for fastening the shielding part 520 to the line 400 or to the jacket 405 thereof.

To mount the contact device 500 on the line end of the line 400, the jacket 405 and the insulation 411 of the individual lines 410 are partially removed, and the contact elements 540 are connected to the individual lines 410 by crimping, as shown in FIG. 4. Subsequently, the contact elements 540 are inserted into the contact insert 510 from the rear and are fastened to the contact insert 510 by latching the latching hooks 542 into the cut-outs 511. The shielding part 520 is then crimped onto the contact insert 510 and onto the line 400.

Figure 5:
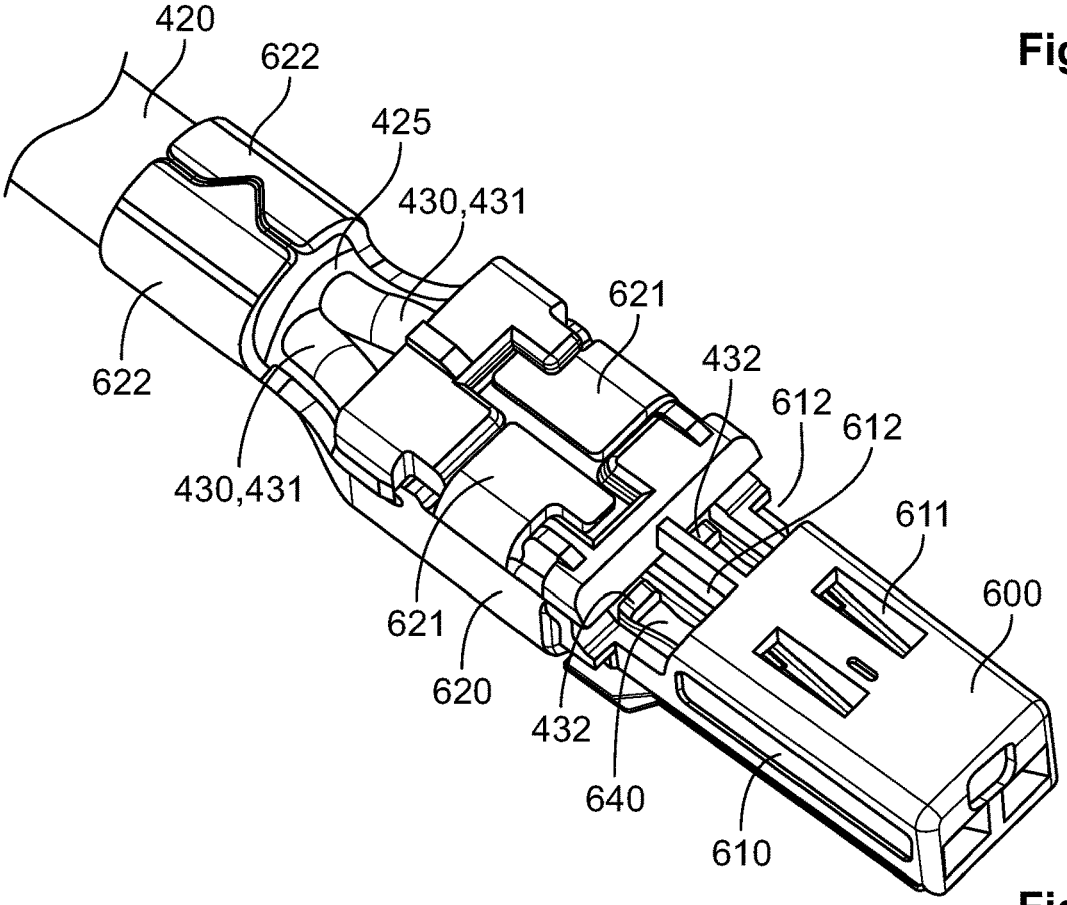
FIG. 5 is a perspective view of a mating contact device.

As shown in FIG. 5, the two-wire line 420 comprises two individual lines 430 which are enclosed by a jacket 425. In the assembled state, the individual lines 430 protrude from the jacket 425 in the area of the line end. The individual lines 430 each have their own insulation 431, which encloses the conductor 432, shown in FIG. 7. The jacket 425 and the insulation 431 can be made of a plastic material. The conductors 432 are designed to be electrically conductive or metallic. As shown in FIG. 5, the mating contact device 600 comprises a contact insert 610, which serves as a housing and is made of a plastic material. The above-mentioned two female mating contact elements 640 are disposed in the insert 610. The mating contact elements 640 are further fastened to the individual lines 430 and connected to the conductors 432 thereof which protrude out from the insulations 431 in the assembled state.

Figure 7:
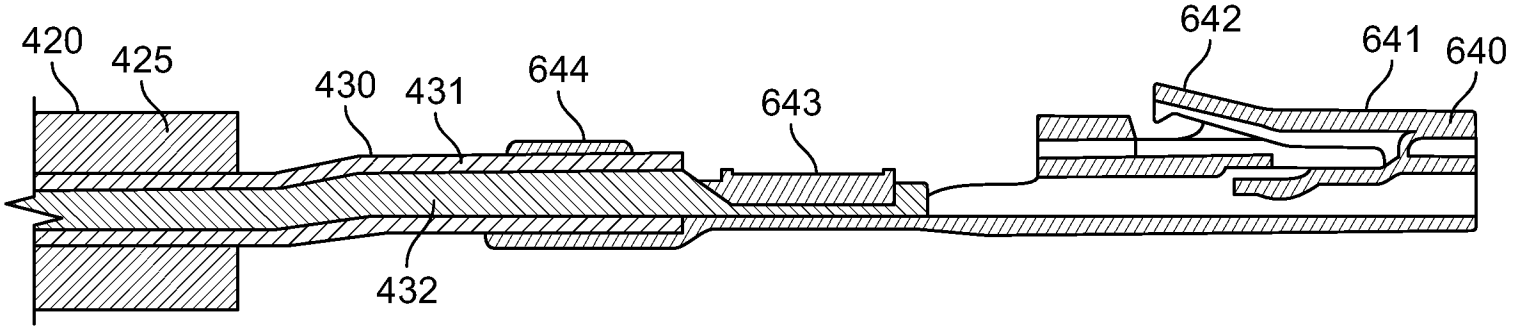
FIG. 7 is a sectional side view of a mating contact element of the mating contact device of FIG. 5.

As shown in FIG. 7 with reference to an individual mating contact element 640, the mating contact elements 640 have crimp tabs 643, 644 disposed in an offset manner to fasten the mating contact elements 640 to the conductor 432 and to the insulation 431 of the associated individual line 430. The mating contact elements 640 also have a socket contact section 641, which comprises a latching hook 642 on the outside. Corresponding to this, the contact insert 610 of the mating contact device 600 shown in FIG. 5 comprises two slot-shaped cut-outs 611, into which the latching hooks 642 of the mating contact elements 640 engage when they are mounted on/in the contact insert 610, and the mating contact elements 640 can thereby be securely attached to the contact insert 610.

FIG. 5 shows that the contact insert 610 has two cut-outs 612 in a central area separated by a web, by which the mating contact elements 640 are also partially released. In this area, a fastening section 281 of the above-mentioned movable fastening part 280 of the mating connector housing 200 can be brought into engagement with the contact insert 610 and the mating contact elements 640, as a result of which these can be securely fixed to the housing part 210 of the mating connector housing 200, shown in FIG. 29.

The mating contact device 600 further comprises the above-mentioned metallic shielding part 620 which, in the assembled state, is disposed on the contact insert 610 and on the line 420, as shown in FIG. 5. The shielding part 620 has two crimping tabs 621 in a front-side section for fastening the shielding part 620 to a rear-side section of the contact insert 610. In this area, the assembled shielding part 620 can have a substantially closed or circumferential shape. The shielding part 620 has two further crimping tabs 622 in a rear section for fastening the shielding part 620 to the line 420 or to jacket 425 thereof.

To mount the mating contact device 600 on the line end of the line 420, the jacket 425 and the insulation 431 of the individual lines 430 are partially removed, and the mating contact elements 640 are connected to the individual lines 430 by crimping. Subsequently, the mating contact elements 640 are inserted into the contact insert 610 from the rear and are fastened to the contact insert 610 by snapping the latching hooks 642 into the cut-outs 611. The shielding part 620 is then crimped onto the contact insert 610 and the line 420.

Figure 23:
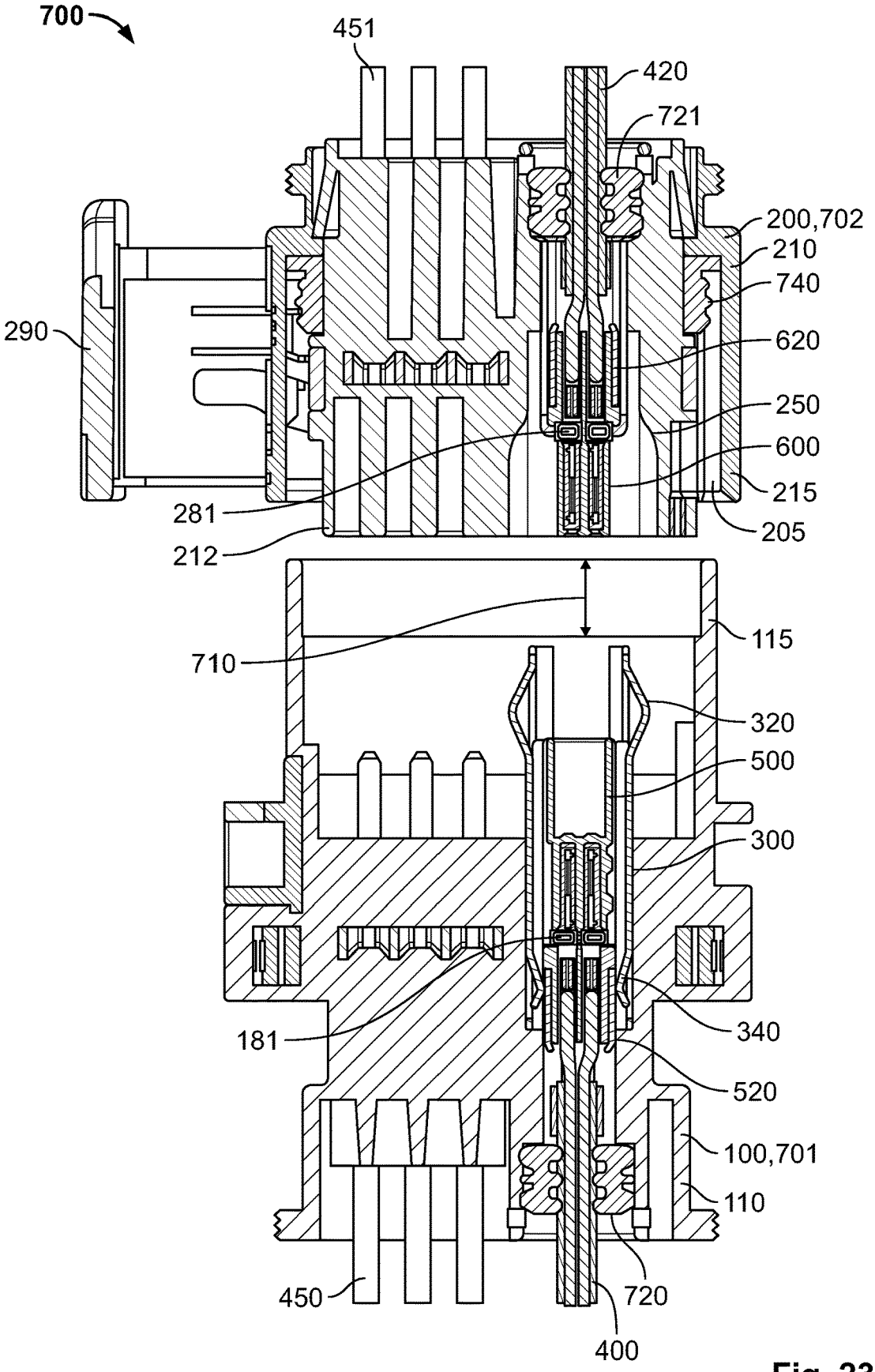
FIG. 23 is a sectional side view of the plug connector and the mating plug connector prior to assembly.
Figure 24:
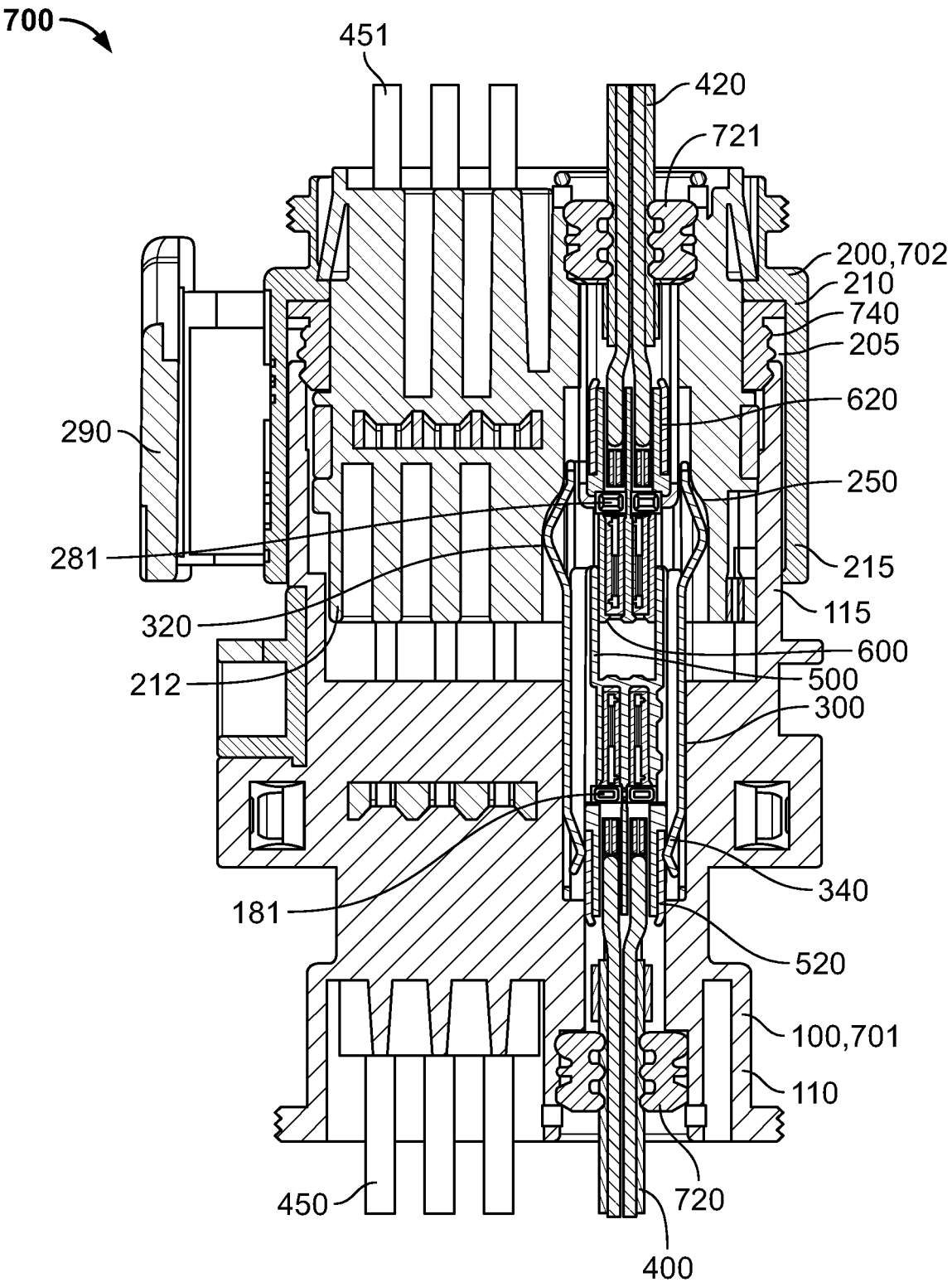
FIG. 24 is a sectional side view of the plug connector and the mating plug connector in an intermediate state of assembly.
Figure 25:
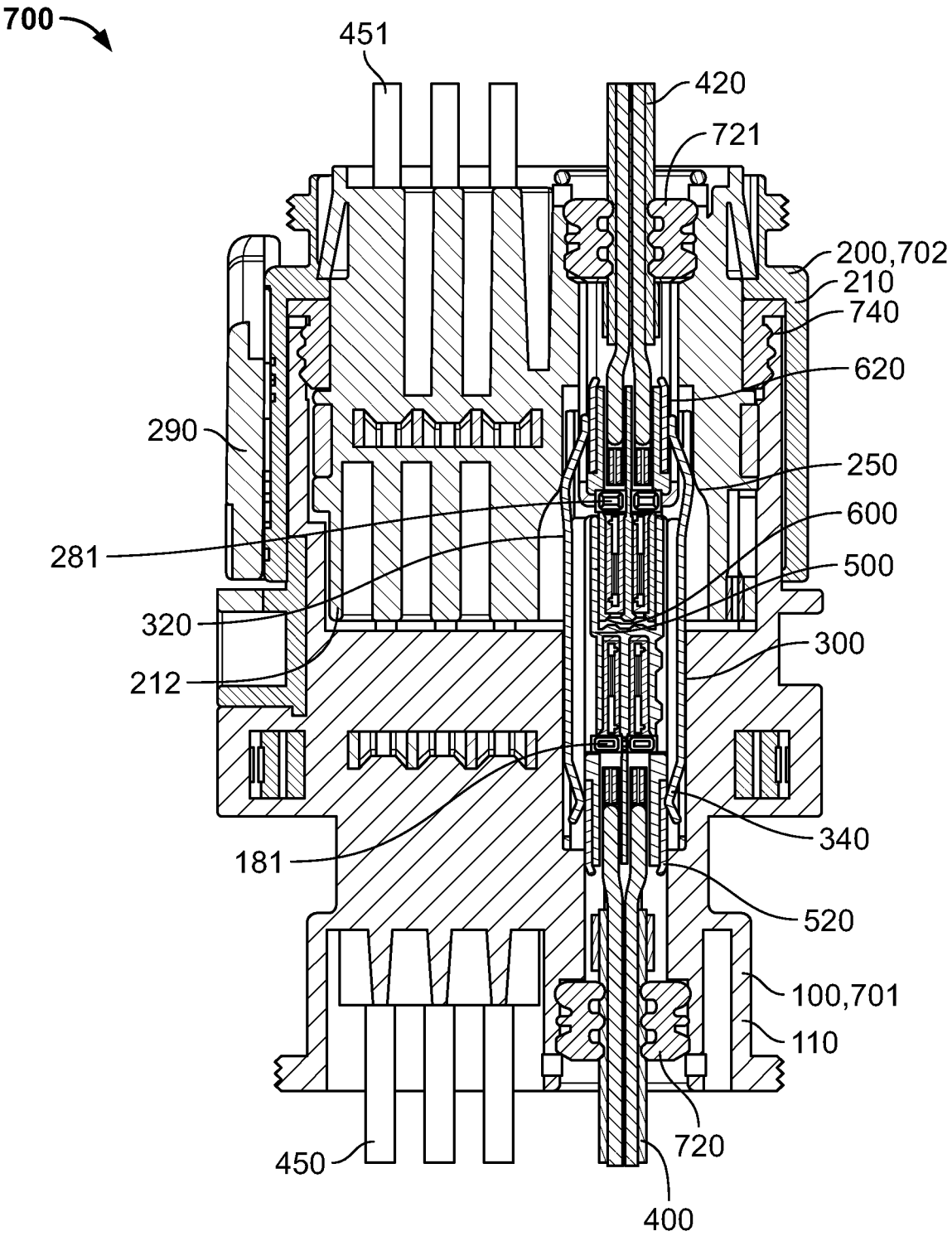
FIG. 25 is a sectional side view of the plug connector and the mating plug connector in the assembled state.

When the housings 100, 200 provided with the contact devices 500, 600 are plugged in, a front section of the contact insert 610 of the mating contact device 600 can be introduced into a front section of the contact insert 510 of the contact device 500, as shown in FIGS. 23-25. As a result, the pin contact sections 548 of the contact elements 540 can be inserted into the socket contact sections 641 of the mating contact elements 640, as a result of which they are electrically connected to one another, as shown in FIG. 29.

Figure 16:
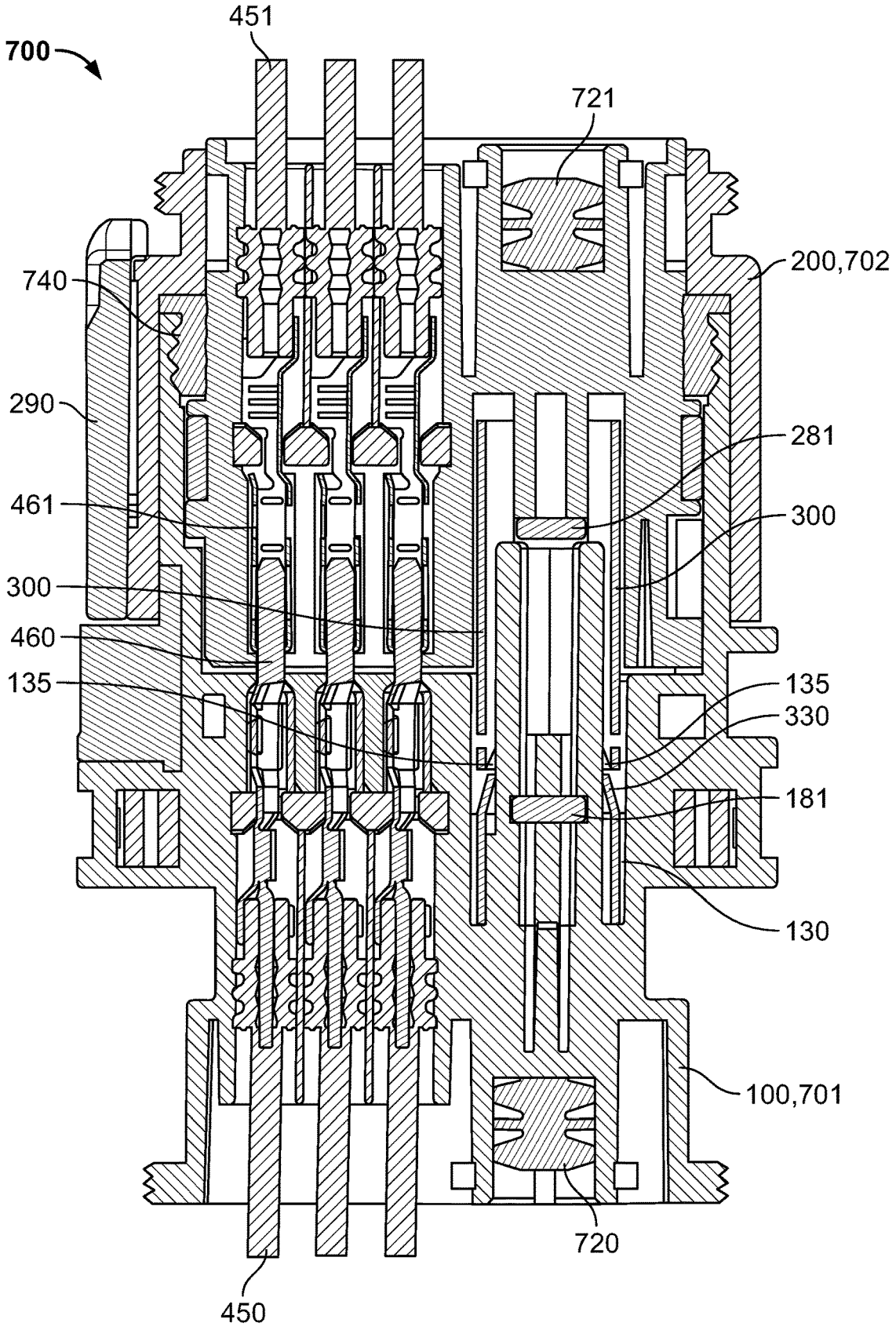
FIG. 16 is a sectional side view of the plug connector and the mating plug connector in the assembled state.

The other contact elements 460, 461, like the contact elements 540, 640, can also be designed with corresponding latching hooks, and, in this way, latched in the associated receiving chambers 140, 240 of the respective housings 100, 200 and thereby fastened (not shown). Correspondingly, the contact elements 460, 461 can be plugged together during the plugging process, as shown in FIG. 16.

FIGS. 8-11 show the metallic shielding element 300 of the connector housing 100. The shielding element 300 has an elongated sleeve-like shape and comprises a plurality of resilient structural elements 320, 330, 340. Materially, the shielding element 300 has a monolithic or one-piece design. In this regard, the shielding member 300 may be made of a sheet metal part, which may involve processing steps such as stamping and bending.

The structure of the shielding element 300, as shown in FIGS. 8-11, is subdivided into a central section 302 and two end or end sections 301, 303, which are referred to below as the front section 301 and the rear section 303. The shielding element 300 has a circumferential shape only in the central section 302. At this point, the shielding element 300 also has a rectangular or substantially rectangular contour, the corners of this contour being curved. In the two end sections 301, 303, the shielding element 300 has cut-outs 351, 353, i.e. a cut-out 351 in the front section 301 and a cut-out 353 in the rear section 303. In these sections 301, 302 there is an incompletely circumferential shape and thus an incomplete rectangular contour; instead, there is a U-shaped or essentially U-shaped contour.

The shielding element 300 also has four flat side walls 311, 312, 313 which are connected to one another via curved sections or corner sections, as shown in FIGS. 8-11. The two opposite side walls 311, which extend over the entire length of the shielding element 300, are provided with the resilient structural elements 320, 330, 340 of the shielding element 300. In this case, the structural elements 320, 330, 340 are designed in the form of stamped-out and partially curved structural elements of the side walls 311.

Figure 8:
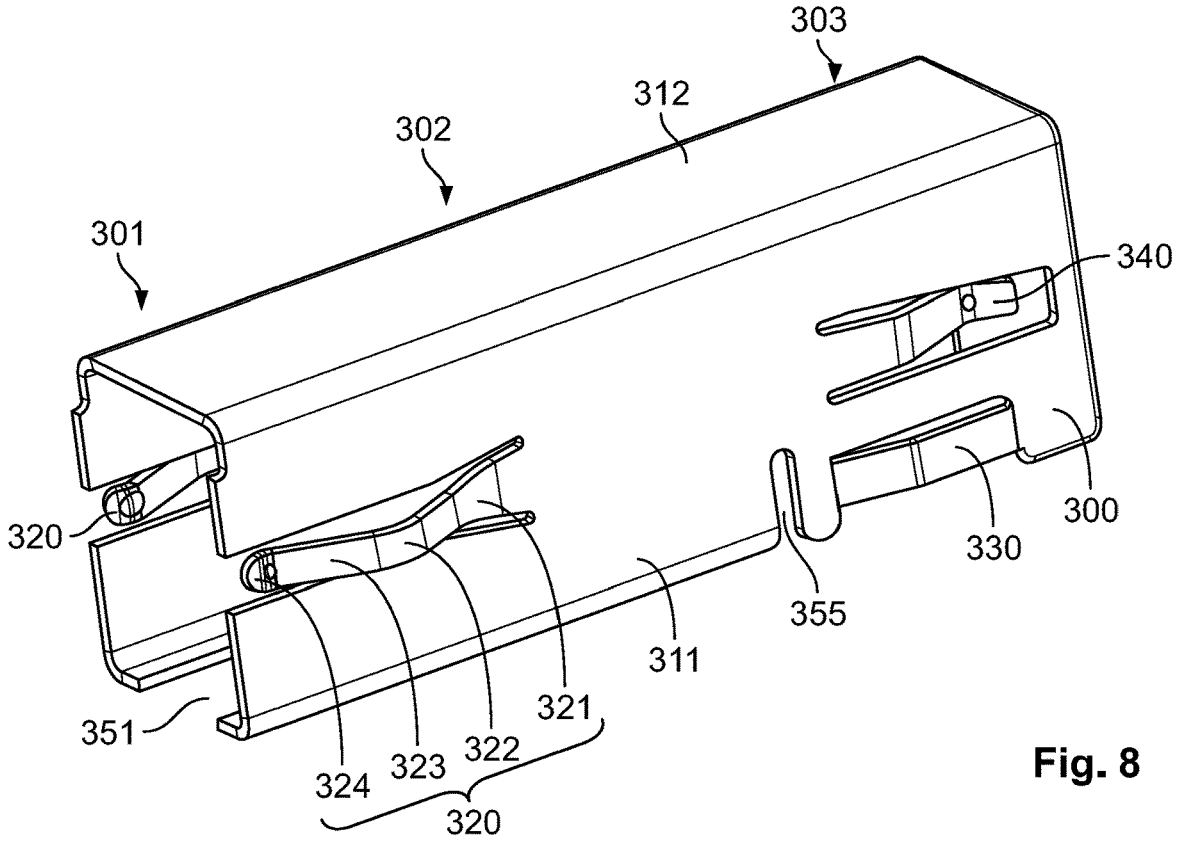
FIG. 8 is a perspective view of a shielding element.
Figure 9:
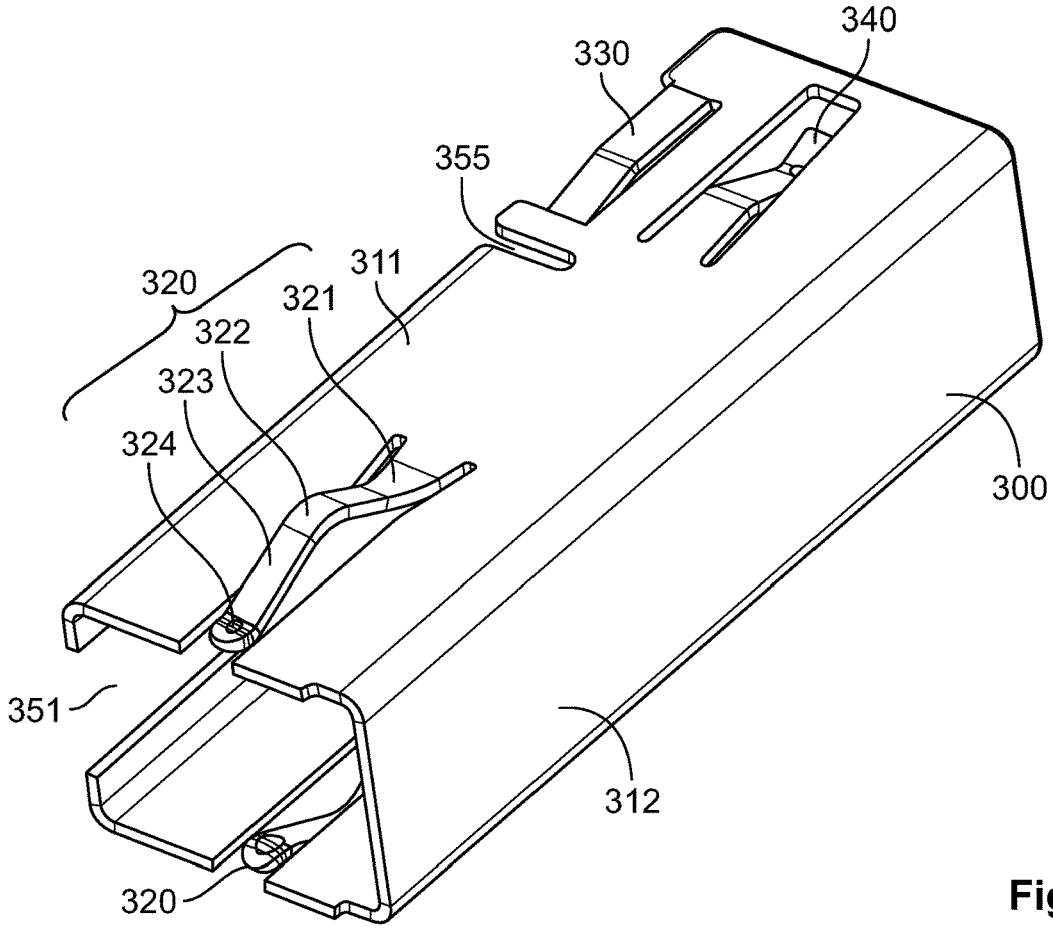
FIG. 9 is another perspective view of the shielding element.
Figure 10:
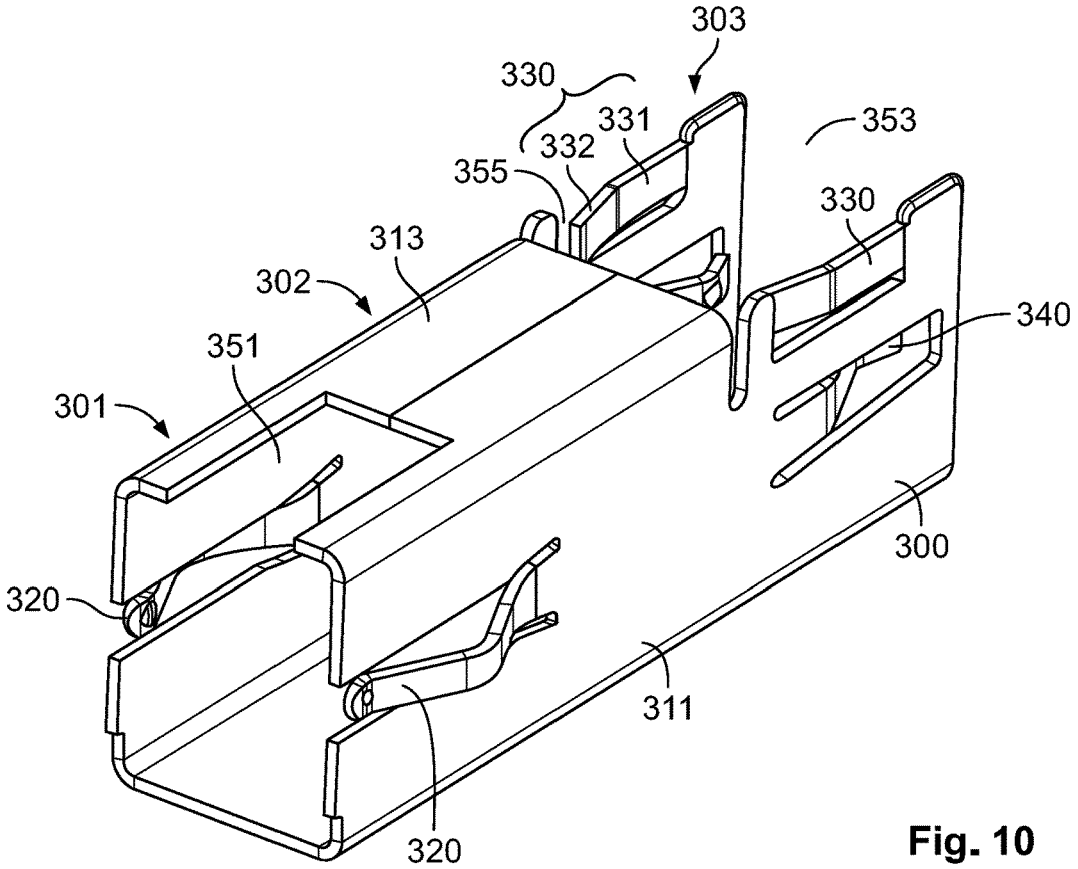
FIG. 10 is another perspective view of the shielding element.
Figure 11:
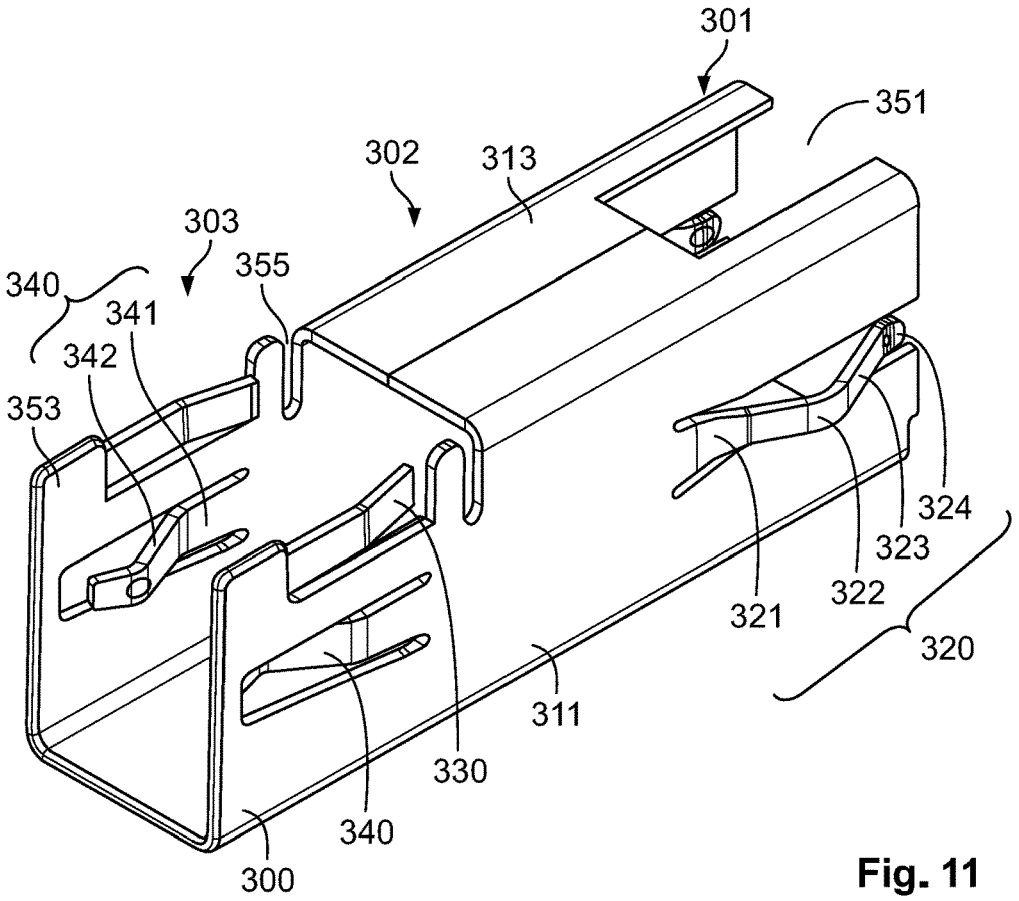
FIG. 11 is another perspective view of the shielding element.

In contrast, the two other opposite side walls 312, 313 have no resilient structural element. In this case, the side wall 312 extends over the entire length of the shielding element 300, as shown in FIGS. 8 and 9. The other side wall 313, which, during the manufacture of the shielding element, is formed by sections of the shielding element 300 that are bent toward one another and in the area of which the cut-outs 351, 353 are formed, has a shorter length due to the cut-outs 351, 353, as shown in FIGS. 10 and 11. In this case, the side wall 313 has a cut-out in the rear section 303 of the shielding element 300 due to cut-out 353, and in the front section 301 due to cut-out 351 comprises only two elongated sections surrounding cut-out 351.

With regard to the resilient structural elements 320, 330, 340, the shielding element 300 shown in FIGS. 8-11 comprises two opposing contact springs 320, which are formed in the front section 301 of the shielding element 300 in the area of the opposite side walls 311. The two contact springs 320 serve to contact the shielding part 620 of the mating contact device 600 during the plugging process between the two connectors 701, 702. Corresponding to this, the mating connector housing 200 of the mating connector 702 has two pressing structures 250, with the aid of which the contact springs 320 can be bent towards one another automatically during the plugging process and can thereby be pressed onto the shielding part 620 from the outside. This will be discussed in more detail below.

The two contact springs 320 of the shielding part 300, as shown in FIGS. 8-11 are coincident and mirror-symmetrical to one another, and have an elongated or strip-like shape. Each contact spring 320 has a shape which protrudes angularly relative to the associated side wall 311, and comprises a connecting section 321 which extends away from the relevant side wall 311, that is to say outwardly with respect to the shielding element 300, and is connected to the side wall 311, a curved section 322 which adjoins the connecting section 321, and a contacting section 323 which forms a free end of the contact spring 320. In this case, the connecting sections 321 and the contacting sections 323 represent legs of the contact springs 320 which protrude in an angular, or in other words triangular, form with respect to the respective side walls 311.

The curvature section 322 of the contact springs 320 is a curved or bent section which is furthest away from the respective side wall 311 or from a plane formed by the side wall 311. The contact springs 320 also have bends or curvatures in the area of the other sections 321, 323. The connecting section 321 of the contact springs 320, adjacent to the respective side wall 311, is slightly curved outwards. The contacting section 323 of the contact springs 320, which, owing to the curved section 322, extends in the direction of the associated side wall 311 or in the direction of a plane formed by the side wall 311, comprises a slightly outwardly curved end section 324 at the end. The end section 324 is located in the area of the plane formed by the side wall 311 in question, so it does not protrude from the side wall 311 or does so only insubstantially. As will be described in more detail below, the actual contacting of the shielding part 620 of the mating contact device 600 takes place by way of contact between the end section 324 of the contacting section 323 of the contact springs 320 and the shielding part 620.

The shielding element 300 shown in FIGS. 8-11 also includes a pair of detent springs 330 lying opposite one another which are formed in the rear section 303 of the shielding element 300 in the area of the opposite side walls 311 at the edges thereof. The two detent springs 330 are used to fasten the shielding element 300 to the housing part 110 of the connector housing 100, as will be explained in more detail below. The detent springs 330 are coincident and mirror-symmetrical to each other, and have an elongated or strip-like shape. Each detent spring 330 comprises a connecting section 331 connected to the respective side wall 311, and a fastening section 322 which adjoins the connecting section 331 and extends away from the side wall 311, i.e. extends inward with respect to the shielding element 300, as shown in FIG. 10. The fastening section 322 forms a free end of the detent spring 320.

As shown in FIGS. 8-11, the shielding element 300 has a pair of spring elements 340 lying opposite one another which are formed in the rear section 303 of the shielding element 300 in the area of the opposite side walls 311. The spring elements 340 contact the shielding part 520 of the contact device 500 during the assembly thereof on/in the housing part 110 of the connector housing 100 by frictional contacting. The spring elements 340 can, therefore, also be referred to as friction contact springs. Details on this will be discussed in more detail below. The spring elements 340 are designed to match and are mirror-symmetrical to one another and have an elongated or strip-like shape. Each spring element 340 has a connecting section 341 which is connected to the respective side wall 311, and a contacting section 342 which adjoins the connecting section 341 and extends substantially away from the side wall 311, that is to say inwards with respect to the shielding element 300, as shown in FIG. 11. The contacting section 342 forms a free end of the spring elements 340 and is slightly bent outwards in the area of the end. As a result, the contacting section 342 has a V-shaped configuration.

Figure 17:
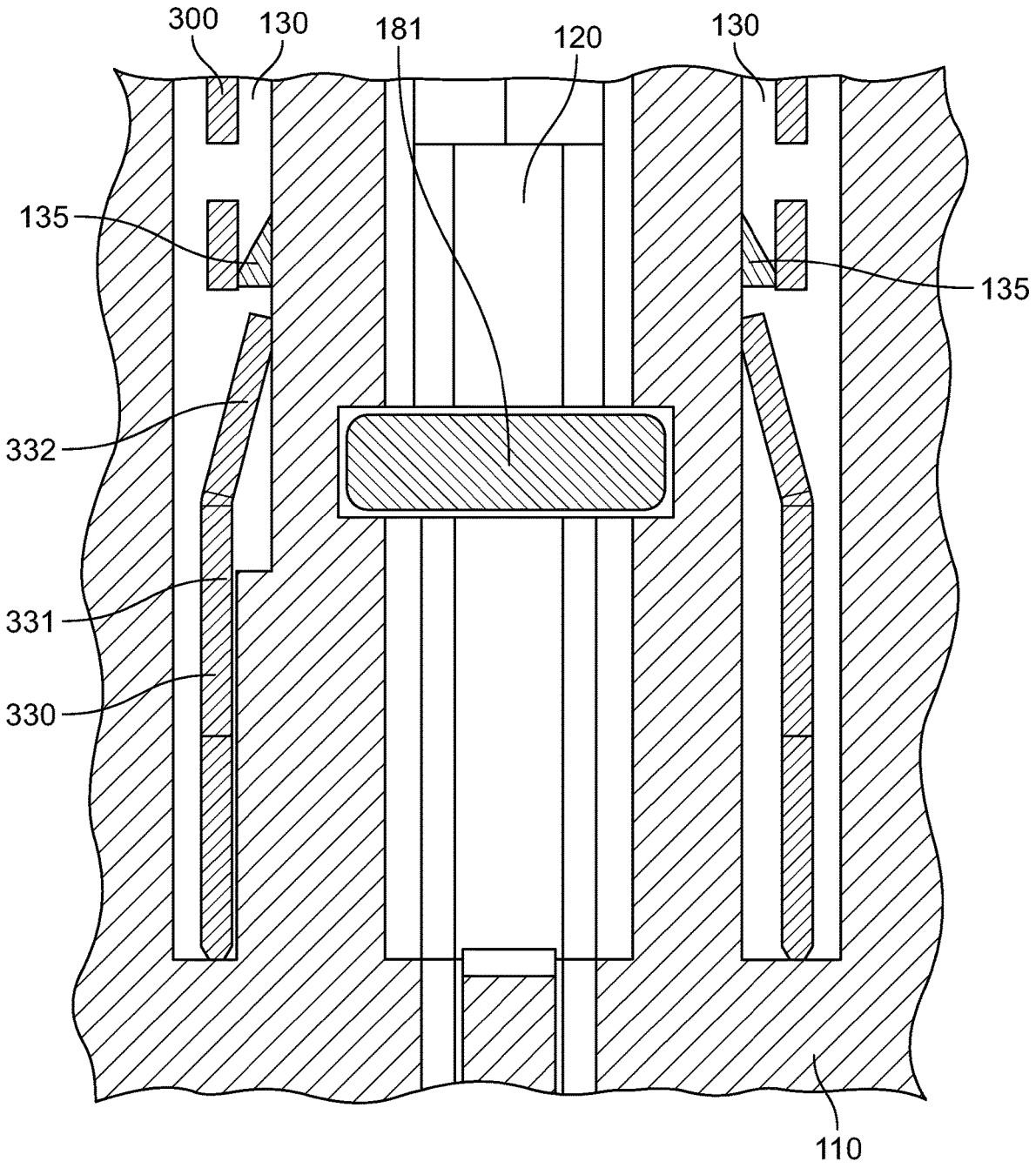
FIG. 17 is an enlarged view of a portion of FIG. 16.

The side walls 311 of the shielding element 300 further each have a relief notch 355 offset from the detent springs 330, as shown in FIGS. 8-11. This can simplify the bending of the shielding element 300 carried out during production, in particular in the central section 302. Furthermore, the shielding element 300 has a closed, in the present case closed and U-shaped, contour at the end of the rear section 303, as shown in FIG. 11. As a result, the shielding element 300 can rest securely on a floor of a receiving area 130 of the housing part 110 of the connector housing 100 provided for the shielding element 300, as shown in FIGS. 16 and 17.

Figure 12:
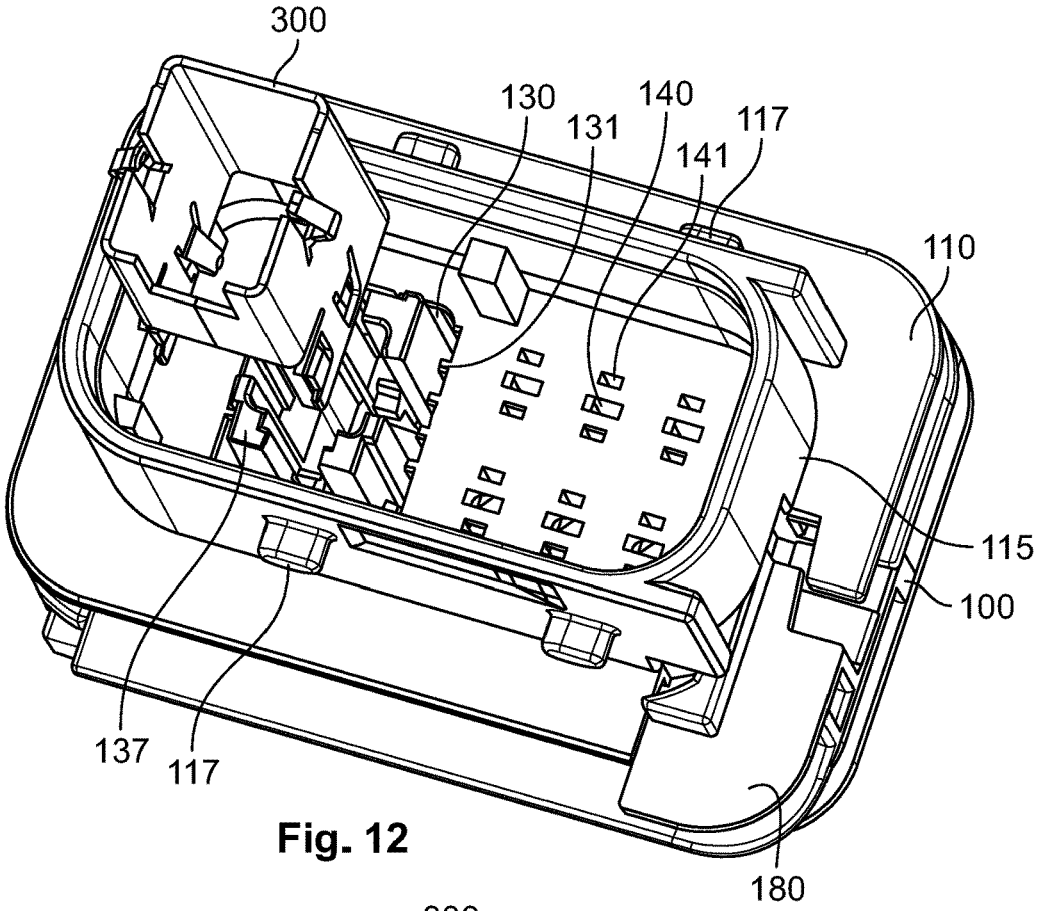
FIG. 12 is a perspective view of a connector housing prior to an insertion of the shielding element.
Figure 13:
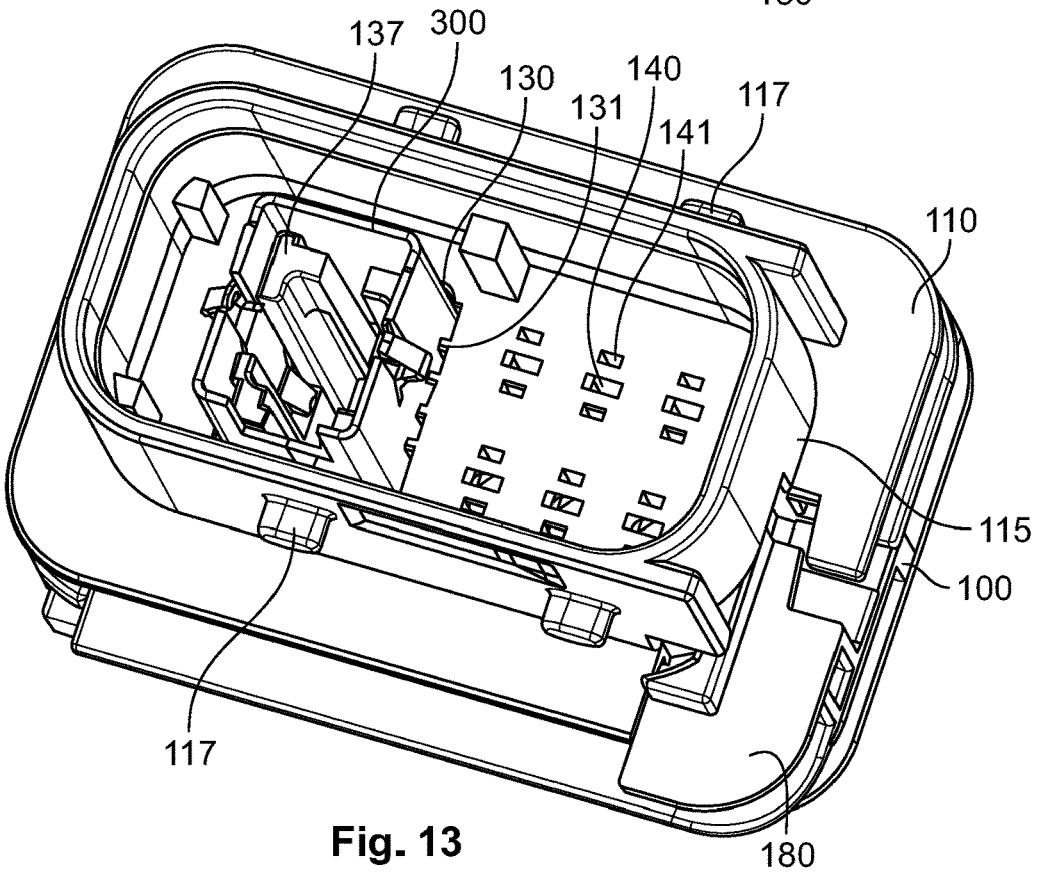
FIG. 13 is a perspective view of the connector housing after insertion of the shielding element.
Figure 14:
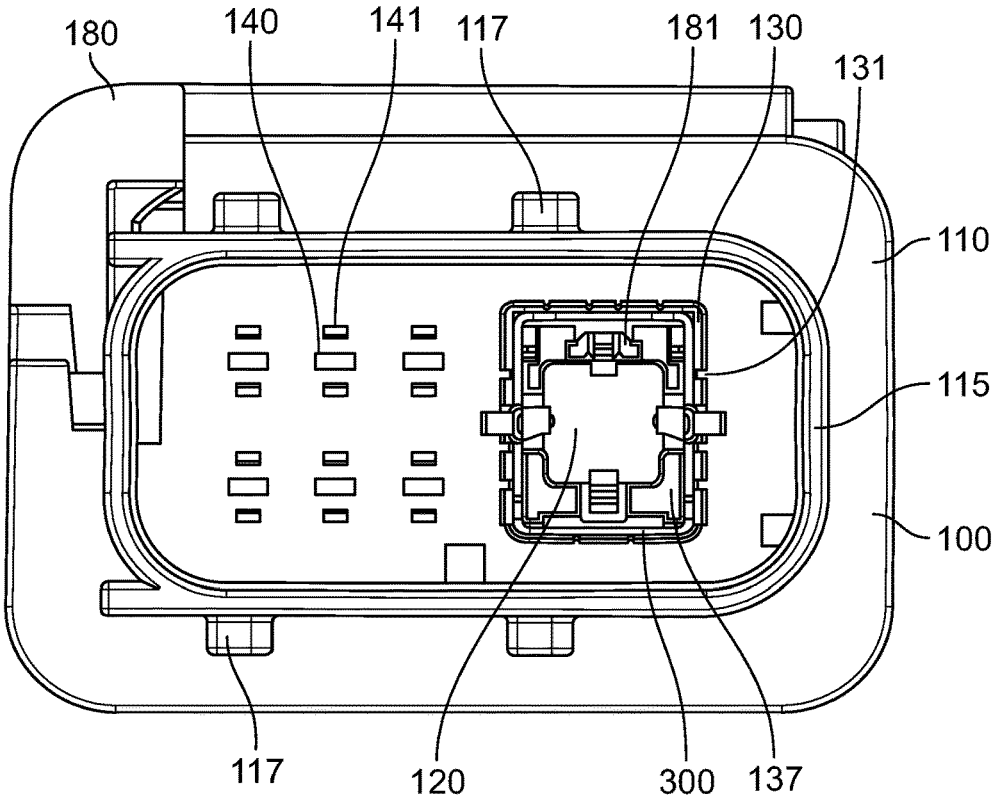
FIG. 14 is a top view of the connector housing with the shielding element.
Figure 15:
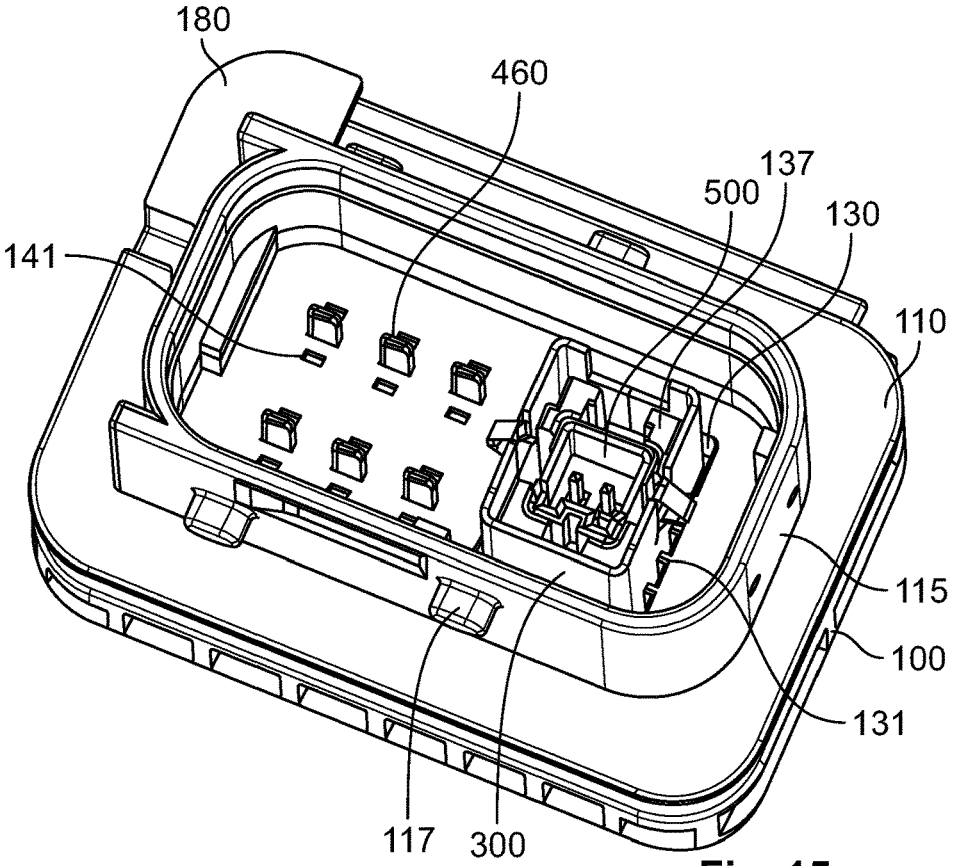
FIG. 15 is a perspective view of the connector housing with the shielding element.

FIG. 12 shows a state before the shielding element 300 is installed, and FIGS. 13 and 14 show the state with the shielding element 300 disposed on the housing part 110 of the connector housing 100. FIG. 15 shows a state with accommodated contact device 500 and accommodated contact elements 460. The housing part 110 comprises, within an area enclosed by the wall 115, the receiving area 130 for receiving a part of the shielding element 300, as well as the receiving chambers 120, 140 for the contact device 500 and the contact elements 460. In the assembled state, these components 300, 460, 500 partially protrude from the housing part 110, as shown in FIG. 15. In addition to the receiving chambers 140, the housing part 110 also has two unlocking openings 141. Using a tool part inserted into the unlocking openings 141, the contact elements 460 can be detached and removed again from the housing part 110.

The receiving area 130 of the housing part 110 is adapted to the shape of the shielding element 300, as shown in FIGS. 12 and 13, and is bordered by corresponding housing walls of the housing part 110. In addition, the housing part 110 comprises a plurality of rib-shaped projections 131 in the area of the receiving area 130, the projections 131 in the assembled state bearing against the outside of the shielding element 300. The shielding element 300 can be disposed securely and in a fixed predetermined position on the housing part 110, even in the event of vibrations. The receiving chamber 120 provided for the contact device is located within the receiving area 130 for the shielding element 300, as shown in FIG. 14.

The housing part 110 also comprises ribs 137 protruding in the area of the front, as shown in FIGS. 13-15, the ribs hereinafter referred to as coding ribs 137. In the assembled state of the shielding element 300, the coding ribs 137 are located within the shielding element 300. The coding ribs 137 serve to achieve a structural association between the shielding element 300 and the housing part 110. In other words, the shielding element 300 can be mounted on the housing part 110, whereas this is not possible for a different shielding element and for a different connector housing with a different size and/or contour.

FIGS. 12-15 partly illustrate the fastening part 180, which is movably disposed on the housing part 110 of the connector housing 100, by which the contact device 500 disposed on/in the housing part 110 can be fixed. The fastening part 180 is shown in an extended starting position in FIGS. 12-15. The fastening part 180 has a fastening section 181 which, in the initial position of the fastening part 180 as indicated in FIG. 14, is located on the edge of the receiving chamber 120 for the contact device 500. Starting from the initial position, the fastening part 180 can be shifted to an end or fastening position in which the fastening section 181 can protrude into the receiving chamber 120 and, as indicated above, can thereby engage in the cut-out 512 of the contact device 500, as shown in FIGS. 4 and 29.

Correspondingly, the shielding element 300 has the cut-out 353 formed in the rear section 303, as shown in FIGS. 10 and 11, for receiving or passing the fastening section 181 therethrough. The fastening part 180 can be moved from the fastening position back into the starting position, as a result of which the contact device 500 can be removed again from the connector housing 100.

FIG. 16 shows a side sectional view of the two connectors 701, 702 in the assembled state. FIG. 17 shows an enlarged view of FIG. 16 in the area of the rear section 303 of the shielding element 300. The sectional plane is located in the area of the detent springs 330 of the shielding element 300. FIGS. 16 and 17 show the mounting position of the shielding element 330 on/in the housing part 110 of the connector housing 100, in which part of the shielding element 300, i.e., in the present case its rear section 303 and a part of the central section 302, is received in the receiving area 130 of the housing part 110 for the shielding element 300. In this case, the rear end or the rear end face of the shielding element 300 is disposed on the bottom of the receiving area 130.

FIGS. 16 and 17 further show that the housing part 110 of the connector housing 100 in the area of or within the receiving area 130 has two detent projections 135 with a wedge shape which are associated with the detent springs 330 of the shielding element 300. When the shielding element 300 is installed, at which point the shielding element 300 is inserted into the receiving chamber 130 on the front side of the housing part 110 as shown in FIGS. 12 and 13, the detent springs 330 and their fastening sections 332 can be moved past the detent projections 135 and thereby bent, which is facilitated by the wedge shape of the detent projections 135. In the assembled state of the shielding element 300, the fastening sections 332 of the detent springs 330 are offset from one another or are located below the detent projections 135, and lie against walls of the housing part 110, on which the detent projections 135 are also formed. Here, the detent springs 330 can press against the walls with a corresponding spring force. The detent springs 330 can be prevented from moving out of the receiving area 130 by the detent projections 135, thereby preventing a detaching of the shielding element 300 from the housing part 110, as a result of which the shielding element 300 is securely fastened to the housing part 110.

Figure 21:
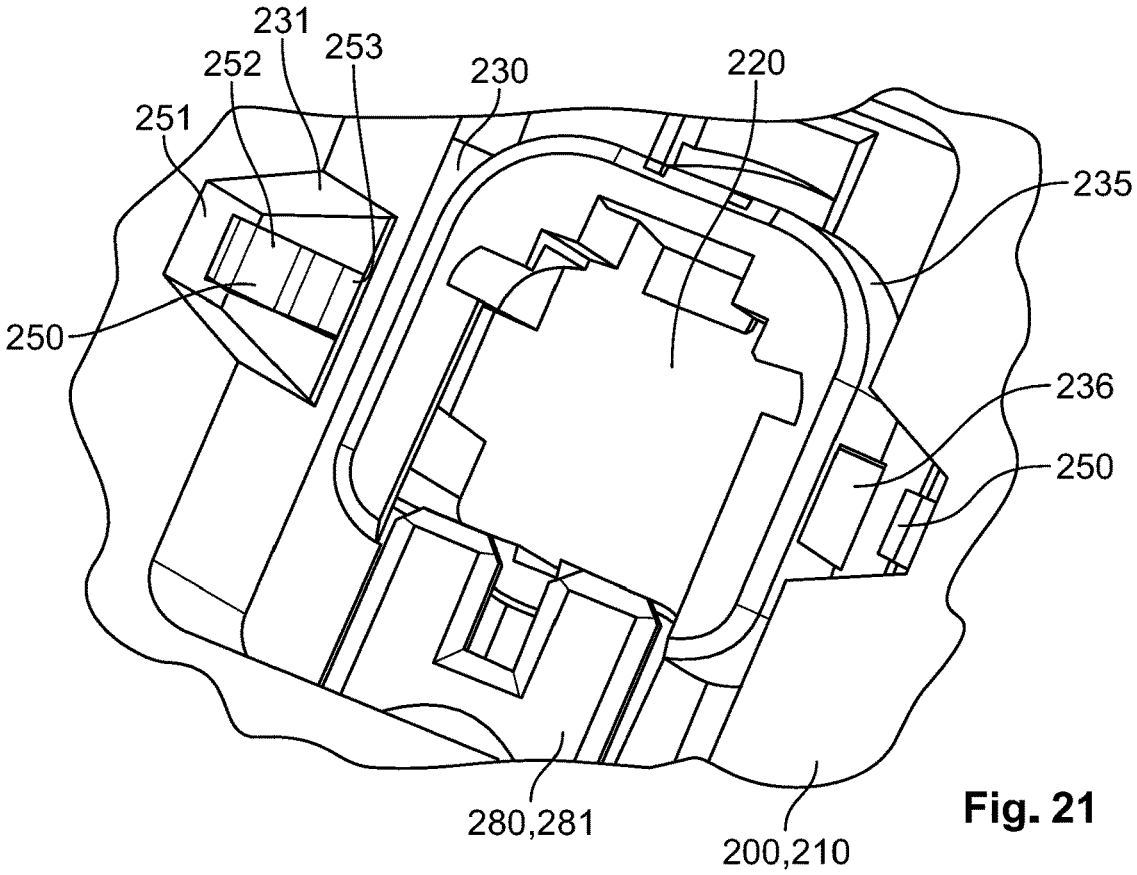
FIG. 21 is a detail view of a portion of FIG. 20.

FIGS. 18-22 show a top view and perspective representations of the mating connector housing 200, that is to say of its front or plug-in side which is provided for plugging. FIGS. 18-21 show a state before and in FIG. 22 after arranging the mating contact device 600 and the mating contact elements 461 on/in the housing part 210 of the mating connector housing 200. FIG. 21 shows an enlarged illustration of FIG. 20 in the area of the receiving chamber 220 for the mating contact device 600 and in the area of the pressing structures 250. Within the circumferential wall 215, the housing part 210 of the mating connector housing 200 comprises a receiving area 205, in which the circumferential front wall 115 of the housing part 110 of the connector housing 100 can be accommodated during the plugging process between the two housings 100, 200, as shown in FIGS. 23-25. The receiving area 205 is bordered on the outside by the wall 215, and on the inside by an inner part 212 of the housing part 210, which is essentially rectangular and has rounded corners when viewed from above. The inner part 212 comprises components such as the receiving chambers 220, 240 provided for receiving the mating contact device 600 and the mating contact elements 641, and the pressing structures 250 used for pressing against the contact springs 320 of the shielding element 300.

As shown in FIGS. 18-20 and 22, the housing part 210 of the mating connector housing 200 also has a plurality of, e.g., six cut-outs 217, which are formed on the front side in the area of the wall 215. Via the two cut-outs 217 on the outside on one side, the locking protrusions 117 of the connector housing 100 can be received in the housing part 210 when the two housings 100, 200 are plugged in, and, as a result (as described above) accommodated in the track-shaped cut-outs 295 of the locking slide 290 of the mating connector housing 200. In addition, the housing part 210 also comprises two unlocking openings 241 in addition to the receiving chambers 240. Using a tool part inserted into the unlocking openings 241, the mating contact elements 461 can be detached and removed from the housing part 210 again.

FIGS. 18-22 also partially show the above-mentioned fastening part 280, which is movably disposed on the housing part 210 and by which the mating contact device 600 disposed on/in the housing part 210 can be fixed. In FIGS. 18-21, the fastening part 280 is shown in an extended starting position and, in FIG. 22, in an end or fastening position shifted relative to the starting position. The fastening part 280 comprises a fastening section 281 which, in the starting position of the fastening part 280, is located on the edge of the receiving chamber 220 for the mating contact device 600. Starting therefrom, the fastening part 280 can be moved to the fastening position, as a result of which the fastening section 281 protrudes into the receiving chamber 220 and, as indicated above, can thereby engage in the cut-outs 612 of the mating contact device 600, as shown in FIGS. 5, 22, and 29. For this purpose, a tool part can be used which can be inserted into one of the cut-outs 217 in the area of the fastening part 280 (left side in FIG. 18). Corresponding to the fastening part 280, the shielding element 300 comprises the cut-out 351 formed in the front section 301, as shown in FIGS. 10 and 11, in order to receive or pass through the fastening section 281 between the two housings 100, 200 during the plugging process. The fastening part 280 can be moved from the fastening position back to the starting position, as a result of which the mating contact device 600 can be removed again from the mating connector housing 200.

The housing part 210 of the mating connector housing 200 shown in FIGS. 18-22 or the inner part 212 thereof comprises a receiving area 230 for the shielding element 300 of the connector housing 100, a part of the shielding element 300, i.e., in the present case the front-side section 301 thereof and part of the central section 302, able to be accommodated between the housings 100, 200 during the plug-in process, as shown in FIGS. 23-25. The receiving area 230 is adapted to the shape of the shielding element 300. As is clear from FIGS. 18-22, the receiving chamber 220 for the mating contact device 600 is located within the receiving area 230 for the shielding element 300. The receiving chamber 220 is, at least in a front section, bordered by a projecting wall 235 of the inner part 212 of the housing part 210. The receiving area 230 for the shielding element 300 is bordered on the inside by the wall 235, and on the out-side by a further housing wall of the inner part 212.

In the area of the receiving area 230 for the shielding element 300, the housing part 210 of the mating connector housing 200 or the inner part 212 thereof comprises the pressing structures 250 provided for pressing against the two contact springs 320 of the shielding element 300. Each of the two pressing structures 250 is realized in the form of a protruding rib-shaped structural element which, viewed from the side, is ramp-shaped. The inner part 212 comprises two cut-outs 231 on the edge of the receiving area 230, within each of which one of the ramp-shaped pressing structures 250 is formed.

Figure 26:
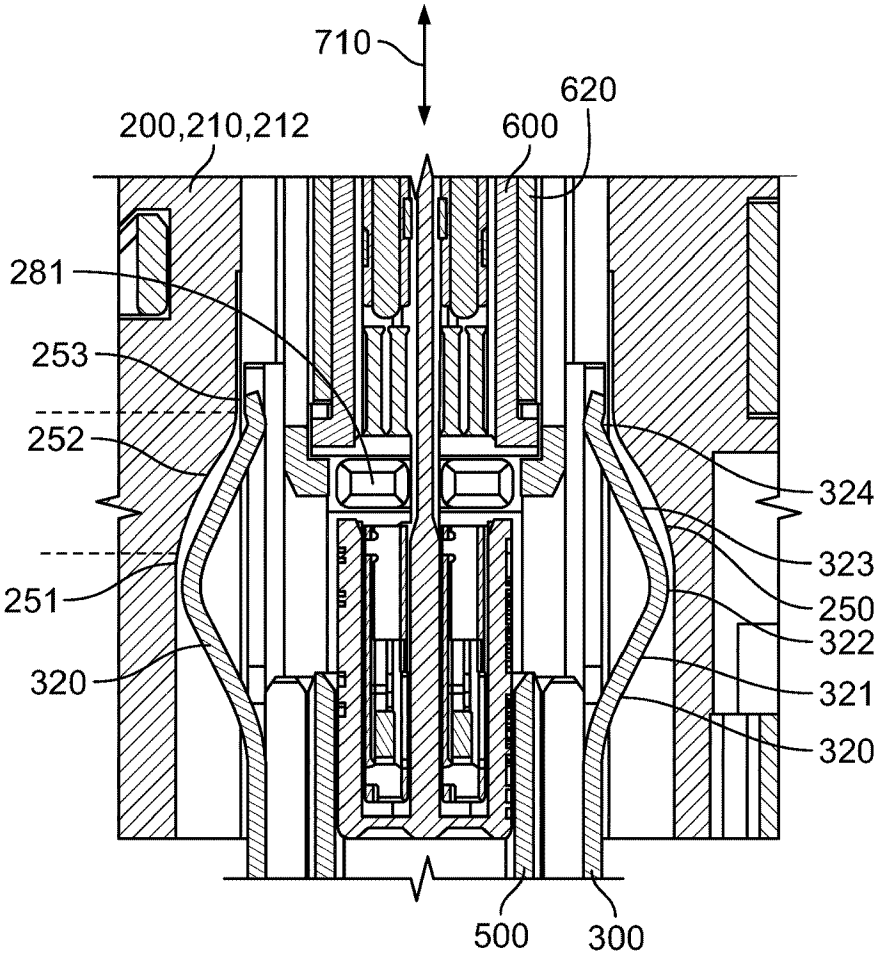
FIG. 26 is an enlarged view of a portion of FIG. 24.

As shown in FIGS. 21 and 26, the housing part 210 or the inner part 212 thereof in the area of the pressing structures 250 each comprise two parallel planar surfaces 251, 253 and a connecting surface 252 connecting the two surfaces 251, 253. The connecting surface 252 extends substantially obliquely relative to the flat surfaces 251, 253 and has a curved, S-shaped shape. Each pressing structure 250 substantially comprises the connection surface 252. Essentially, the contact springs 320 of the shielding element 300 are pressed together on the connecting surfaces 252.

Corresponding to the pressing structures 250, the wall 235 of the inner part 212 of the housing part 210 of the mating connector housing 200 is formed with cut-outs 236 opposite the pressing structures 250, as shown in FIG. 21 with the aid of a cut-out 236. The cut-outs 236 serve to pass through the contact springs 320 of the shielding element 300 of the connector housing 100, the springs being bent during the plugging process between the two housings 100, 200 with the aid of the pressing structures 250.

FIG. 23 shows a sectional side view of the two connectors 701, 702 of the plug-in system 700 immediately before they are plugged together. In this case, the sectional plane runs in the area of the contact springs 320 and spring elements 340 of the shielding element 300 of the connector housing 100 and in the area of the pressing structures 250 of the mating connector housing 200. The manner of contact of the shielding part 520 of the contact device 500 accommodated on/in the housing part 110 of the connector housing 100 is clear from this illustration.

When the contact device 500 is installed, in which the contact device 500 and thus its shielding part 520 are inserted into the receiving chamber 120 of the housing part 110 provided for the contacting device 500 and thus into an area within the shielding element 300, the spring elements 340 formed in the rear section 303 of the shielding element 300 and opposite one another are slightly bent apart by the contact device 500. When the contact device 500 moves past, the contacting sections 342 of the spring elements 340, as shown in FIG. 11, rub along the contact device 500 and along the shielding part 520. In the mounting position of the contact device 500, as shown in FIG. 23, the spring elements 340 of the shielding element 300 bear on the shielding part 520 with a contact pressure, as a result of which the shielding part 520 and the shielding element 300 are electrically connected to one another.

FIG. 23 also shows that the housing part 210 of the mating connector housing 200 has a further sealing element 740 within the receiving area 205 provided for receiving the front circumferential wall 115 of the connector housing 100. As a result, a seal can be created between the two housings 100, 200 at this point in the plugged-in state, as also shown in FIG. 25.

Figure 27:
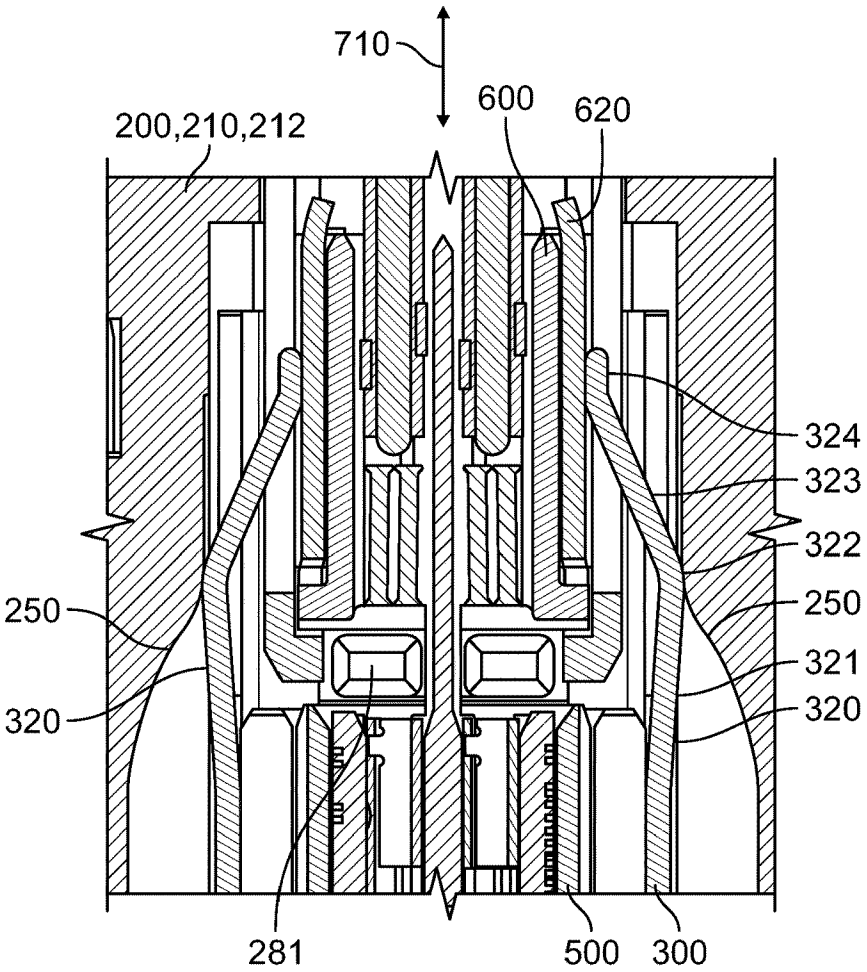
FIG. 27 is an enlarged view of a portion of FIG. 25.

FIGS. 24-27 show further lateral sectional representations of the two connectors 701, 702 of the system 700 which clarify the details of the plugging process in relation to the shielding element 300. FIG. 24 shows a partially plugged-in state and in FIG. 25 a completely plugged-in state of the connectors 701, 702. FIGS. 26 and 27 additionally show enlarged representations of FIGS. 24 and 25 in the area of the contact springs 320 of the shielding element 300 and in the area of the pressing structures 250 of the mating connector housing 200. The sectional plane of FIGS. 24-27 corresponds to that of FIG. 23.

During the plugging process between the two connectors 701, 702 and their housings 100, 200, the wall 115 of the connector housing 100 is received in the cut-out 205 of the mating connector housing 200 and the inner part 212 of the mating connector housing 200 in an area within the wall 115 of the connector housing 100, as is the case is shown in FIGS. 24 and 25. Furthermore, the mating contact device 600 is inserted into contact device 500, which is associated with an insertion of the contact elements 540 of the contact device 500 into the mating contact elements 640 of the mating contact device 600, as shown in FIG. 29. The other contact elements 460 are also inserted into the associated mating contact elements 461, as show in FIG. 16.

During the plug-in process, the shielding part 620 of the mating contact device 600 disposed on the mating connector housing 200 is also introduced into an area within the shielding element 300 of the connector housing 100, as shown in FIGS. 24-27. At the same time, the contact springs 320 of the shielding element 300 are automatically bent apart by the pressing structures 250 of the mating connector housing 200. As the plugging process progresses, the contact springs 320 of the shielding element 300 are increasingly bent with the aid of the pressing structures 250 and are thereby pressed against the shielding part 620 of the mating contact device 600 from the outside on opposite sides under normal force with a corresponding contact pressure so that the shielding part 620 is contacted by the shielding element 300. The mating connector housing 200 or its pressing structures 250 are consequently used for shield activation in this process. When the connectors 701, 702 are connected, the shielding part 620 and the shielding element 300, and consequently also the two shielding parts 520, 620 of the contact devices 500, 600, are electrically connected to one another by way of the shielding element 300.

The actual contacting of the shielding part 620 of the mating contact device 600 takes place by way of the end sections 324 of the contacting sections 323 of the contact springs 320 of the shielding element 300, the end sections 324 being brought into contact with the shielding part 620. Furthermore, the automatic bending of the contact springs 320 takes place by way of contact between the pressing structures 250 and the contact springs 320 substantially in the area of the contacting sections 323 of the contact springs 320 and additionally also in the area of the curved sections 322 of the contact springs 320 of the shielding element 300. On the part of the pressing structures 250, the bending and pressing of the contact springs 320 of the shielding element 300 against the shielding part 620 is substantially effected by way of the connecting surfaces 252, and also by way of the surfaces 253 at the end of the plugging process.

In the present case, the pressing of the contact springs 320 against the shielding part 620 of the mating contact device 600 begins only in the final phase of the plugging process, that is to say in a state in which the two connectors 701, 702 and their housings 100, 200 are already largely plugged together. In this way, the contacting of the shielding part 620 by way of the contact springs 320 of the shielding element 300 is associated with only a slight rubbing of the contact springs 320 along the shielding part 620. The lateral friction results from the relative movement occurring during the plugging process between the housings 100, 200 and thus between the shielding element 300 and the shielding part 620 in the plugging direction 710. As a result, only slight wear occurs on the contact springs 320 of the shielding element 300 and on the shielding part 620 during the plugging process.

When the connectors 701, 702 and their housings 100, 200 are unplugged, as a result of which the pressing structures 250 of the mating connector housing 200 are also removed from the contact springs 320 of the shielding element 300 of the connector housing 100, the contact springs 320 of the shielding element 300 can automatically detach in a corresponding manner from the shielding part 620 of the mating contact device 600 disposed on the mating connector housing 200 and assume their original shape before the plugging process. Even in this process in which the contact springs 320 of the shielding element 300 can lift off from the shielding part 620 of the mating contact device 600 even at the beginning of the unplugging of the two housings 100, 200, only slight friction occurs along the contact springs 320 on the shielding part 620 due to the relative movement between the shielding element 300 and the shielding part 620 in the plugging direction 710.

The plugging and unplugging of the two connectors 701, 702 of the system 700, and thus of their housings 100, 200, can consequently be carried out with low contact friction on the shielding element 300 of the connector housing 100 and on the shielding part 620 of the mating contact device 600 of the mating connector housing 200. This makes these components 100, 200, 701, 702 suitable for a large number of plugging cycles. In this context, the ramp-shaped configuration of the pressing structures 250 of the mating connector housing 200 also proves to be favorable, which makes it possible to bend the contact springs 320 of the shielding element 300 in a manner that is gentle on the material.

Figure 28:
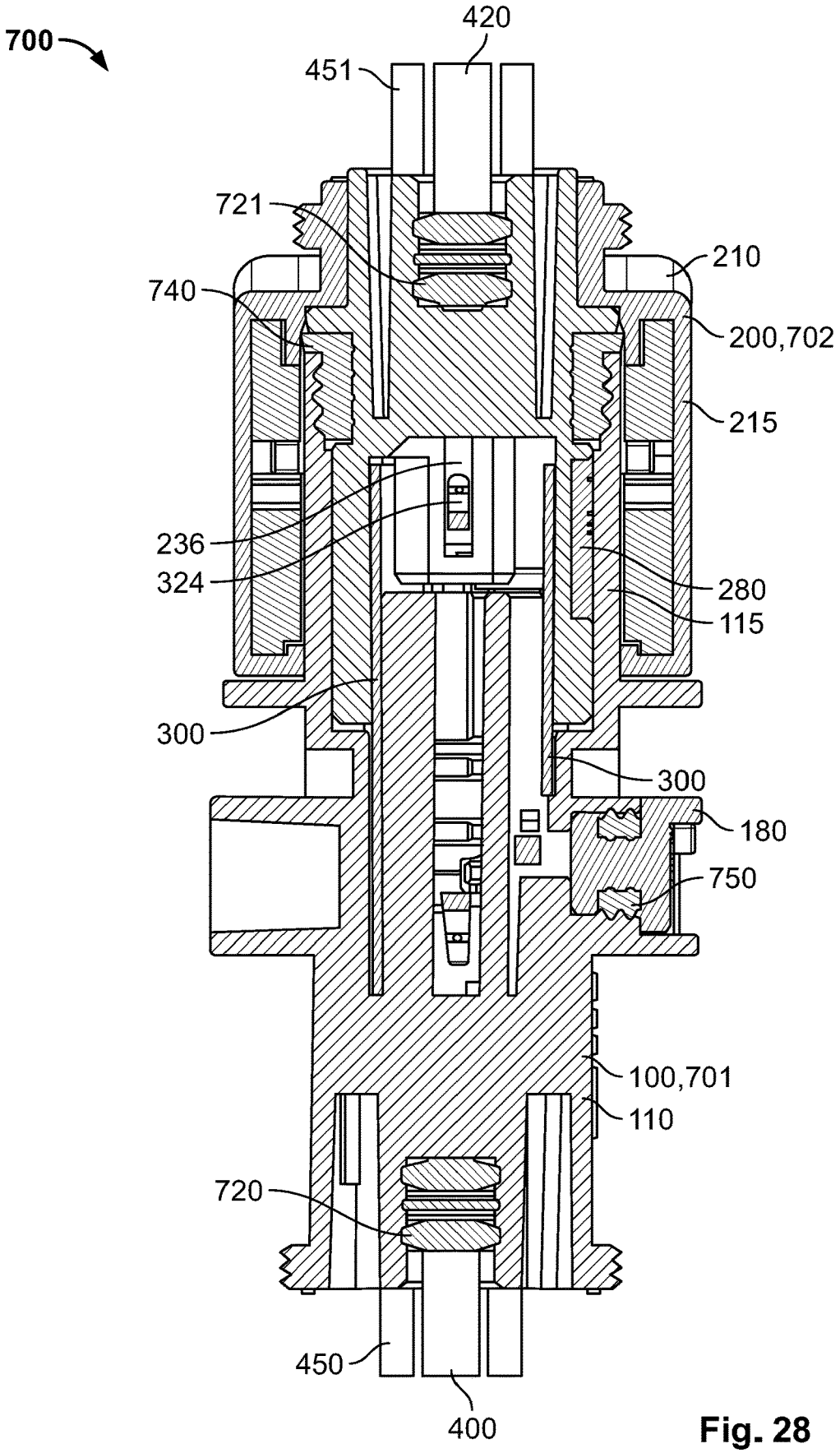
FIG. 28 is a sectional side view of the plug connector and the mating plug connector in the assembled state.

As described above with reference to FIG. 21, the wall 235 of the mating connector housing 200 comprises cut-outs 236 relating to the bending of the contact springs 320 of the shielding element 300 effected by the pressing structures 250, the cut-outs disposed opposite to the pressing structures 250. In this case, the contact springs 320 can be guided through the cut-outs 236 during the bending and can thereby be brought into contact with the shielding part 620 of the mating contact device 600. FIG. 28 shows a further lateral sectional illustration of the connectors 701, 702 and the housings 100, 200 in the assembled state, the sectional plane being situated near an end section 324 of a contacting section 323 of a contact spring 320 of the shielding element 300.

FIG. 29 shows a further sectional side view of the connectors 701, 702 and the housings 100, 200 in the assembled state, the sectional plane being situated in the area of the fastening sections 181, 281 of the fastening parts 180, 280 of the housings 100, 200. The above-mentioned fixing of the contact devices 500, 600 by the fastening sections 181, 281 of the fastening parts 180, 280 is clear from this illustration. It can also be seen that the connector housing 100 comprises a further sealing element 750 in the area of the fastening part 180 of the housing in order to seal the housing 100 at this point. A corresponding configuration with a further sealing element can also be provided in the mating connector housing 200 in the area of the fastening part 280 thereof.

FIG. 29 shows that the housing part 110 of the connector housing 100 comprises two resilient latching hooks 160 formed in the area of the receiving chamber 120. With the aid of the latching hook 160, the contact device 500 can be latched when it is mounted on/in the housing part 110. Correspondingly, the housing part 210 of the mating connector housing 200 has a resilient latching hook 260 formed in the area of the receiving chamber 220. As a result, the mating contact device 600 can be latched when it is mounted on/in the housing part 210.

In addition to the embodiments described above and shown in the figures, further embodiments are conceivable which may include further modifications and/or combinations of features. For example, connectors 701, 702, housings 100, 200 and components thereof which have different configurations from the above description and/or from the figures can be realized.

One example is a shielding element 300 of a connector housing 100 which has a different number of contact springs 320. This also includes a configuration of a shielding element 300 with only one contact spring 320. In an analogous manner, a mating connector housing 200 with a correspondingly different number of pressing structures 250 or with only one pressing structure 250 can be used. The same applies, for example, to detent springs 330 and/or spring elements 340 of a shielding element 300.

The pressing or normal force with which a contact spring 320 of a shielding element 300 of a connector housing 100 can be pressed onto a shielding part 620 disposed on a mating connector housing 200 when the housing 100, 200 is plugged in depends on the configuration of the contact spring 320 of the shielding element 300 and/or the configuration of the mating connector housing 200. In this respect, it is possible, for example, to adapt the normal force by changing the configuration of the contact spring(s) 320.

In another embodiment, it is possible to use lines 400, 420 which have shields. The shields of the lines 400, 420 can be contacted with the aid of shielding parts 520, 620, a contact device 500 and a mating contact device 600. For this purpose, the relevant shielding parts 520, 620 may have additional crimping tabs, in deviation from the configurations shown in FIGS. 4 and 5.

Although the invention has been illustrated and described in the exemplary embodiments, the invention is not restricted by the disclosed examples and other variations can be derived therefrom by a person skilled in the art without departing from the scope of protection of the invention.

What is claimed is:

1. A connector housing for an electrical connector, comprising:

a housing part; and a shielding element disposed on the housing part, the shielding element has a contact spring contacting a shielding part of a mating connector housing, the contact spring is bent and pressed against the shielding part during a plugging operation between the connector housing and the mating connector housing, the shielding element has a detent spring fastening the shielding element to the housing part, the contact spring has a connecting section extending away from a side wall of the shielding element and connected to the side wall and a curved section adjoining the connecting section, the connecting section is positioned between a pair of ends of the shielding element along a plug-in direction of the connector housing, the curved section extending outward from the shielding element beyond the side wall, the contact spring has a contacting section adjoining the curved section and forming a free end of the contact spring, the free end of the contact spring at the contacting section is positioned closer to an end of the pair of ends of the shielding element than the connecting section along the plug-in direction.

2. The connector housing of claim 1, wherein the shielding element has a pair of opposite contact springs contacting the shielding part.

3. The connector housing of claim 2, wherein the contact springs are bent toward one another and pressed on a pair of opposite sides of the shielding part during the plugging operation between the connector housing and the mating connector housing.

4. The connector housing of claim 1, wherein the housing part receives a contact device attached on an electrical line.

5. The connector housing of claim 4, wherein the shielding element has a spring element contacting a shielding part of the contact device.

6. The connector housing of claim 1, further comprising a fastening part movably disposed on the housing part, the fastening part having a fastening section fixing a contact device receivable in the housing part.

7. The connector housing of claim 6, wherein the shielding element has a cut-out for the fastening section.

8. The connector housing of claim 1, wherein the shielding element has a cut-out for a fastening section of a movable fastening part of the mating connector housing.

9. The connector housing of claim 1, wherein the housing part has a receiving area for the shielding element, the housing part has a plurality of rib-shaped projections in the receiving area abutting against the shielding element.

10. A mating connector, comprising:

a mating connector housing having a pressing structure; and a mating contact device disposed in the mating connector housing, the mating contact device having a contact insert, a mating contact element disposed in the contact insert, and a shielding part disposed around the contact insert, a contact spring of a shielding element of a connector housing is bendable during a plugging process between the connector housing and the mating connector housing with the aid of the pressing structure and is pressed onto the shielding part.

11. The mating connector housing of claim 10, wherein the pressing structure has a ramp-shape.

12. The mating connector housing of claim 10, wherein the mating contact element is attached to an electrical line.

13. The mating connector housing of claim 10, wherein the mating connector housing has a receiving chamber receiving the mating contact device, the receiving chamber is bordered by a projecting wall.

14. The mating connector housing of claim 13, wherein the projecting wall has a cut-out in an area of the pressing structure through which the contact spring can be passed.

15. The mating connector housing of claim 10, wherein the mating connector housing has a pair of pressing structures, a pair of contact springs of the shielding element are bendable towards one another during the plugging process with the aid of the pressing structures and pressed on a pair of opposite sides of the shielding part.

16. A system, comprising:

a connector housing including a housing part and a shielding element disposed on the housing part, the shielding element has a contact spring; and a mating connector including a mating connector housing matable with the connector housing in a plugging operation and a mating contact device disposed in the mating connector housing, the mating connector housing having a pressing structure, the mating contact device having a contact insert, a mating contact element disposed in the contact insert, and a shielding part disposed around the contact insert, the shielding element contacting the shielding part, the contact spring is bent and pressed against the shielding part during the plugging operation with the aid of the pressing structure.

17. The connector housing of claim 1, wherein the free end of the contact spring at the contacting section abuts the shielding part of the mating connector housing.

18. A connector housing for an electrical connector, comprising:

a housing part receiving a contact device attached on an electrical line; and a shielding element disposed on the housing part, the shielding element has a contact spring contacting a shielding part of a mating connector housing, the contact spring is bent and pressed against the shielding part during a plugging operation between the connector housing and the mating connector housing, the shielding element has a detent spring fastening the shielding element to the housing part, the contact spring has a connecting section extending away from a side wall of the shielding element and connected to the side wall and a curved section adjoining the connecting section, the connecting section is positioned between a pair of ends of the shielding element along a plug-in direction of the connector housing, the curved section extending outward from the shielding element beyond the side wall, the shielding element has a spring element contacting a shielding part of the contact device.

* * * * *